US010697256B2

(12) United States Patent
Wiedecke et al.

(10) Patent No.: US 10,697,256 B2
(45) Date of Patent: Jun. 30, 2020

(54) ELECTRONIC CONTROL SYSTEM FOR A TUBULAR HANDLING TOOL

(71) Applicant: Weatherford Technology Holdings, LLC, Houston, TX (US)

(72) Inventors: Michael Wiedecke, Salzhemmendorf (DE); Bjoern Thiemann, Burgwedel (DE); Karsten Heidecke, Houston, TX (US); Martin Liess, Seelze (DE); Martin Helms, Burgdorf (DE); John D. Hooker, II, Houma, LA (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 286 days.

(21) Appl. No.: 15/193,722

(22) Filed: Jun. 27, 2016

(65) Prior Publication Data

US 2016/0376856 A1 Dec. 29, 2016

Related U.S. Application Data

(62) Division of application No. 13/327,296, filed on Dec. 15, 2011, now Pat. No. 9,404,322.

(Continued)

(51) Int. Cl.
*E21B 19/07* (2006.01)
*E21B 19/16* (2006.01)

(Continued)

(52) U.S. Cl.
CPC ..... *E21B 19/07* (2013.01); *E21B 19/00* (2013.01); *E21B 19/10* (2013.01); *E21B 19/16* (2013.01);

(Continued)

(58) Field of Classification Search
CPC ..... E21B 17/003; E21B 19/16; E21B 19/06; E21B 19/07; E21B 19/164; E21B 19/165; E21B 19/10; E21B 19/00; E21B 47/00
See application file for complete search history.

(56) References Cited

U.S. PATENT DOCUMENTS 4,545,017 A 10/1985 Richardson
4,604,724 A 8/1986 Shaginian et al.

(Continued)

FOREIGN PATENT DOCUMENTS

EP 1426550 A1 6/2004
EP 1808568 A2 7/2007

(Continued)

OTHER PUBLICATIONS

EPO Extended European Search Report dated May 9, 2017, for European Patent Application No. 16204627.0.

(Continued)

*Primary Examiner* — Nicole Coy
(74) *Attorney, Agent, or Firm* — Patterson + Sheridan, LLP

(57) ABSTRACT

An electronic control system comprises a first tubular handling tool, a sensor, and a controller. The controller is configured to control actuation of the first tubular handling tool in response to an electronic signal received from the sensor that corresponds to an operational characteristic of the first tubular handling tool. The electronic control system functions as an electronic interlock system to prevent mishandling of a tubular. A method of controlling a tubular handling tool comprises measuring an operational characteristic of the tubular handling tool, communicating the operational characteristic to a controller in the form of an (Continued)

electronic signal, and using the controller to control actuation of the tubular handling tool in response to the measured operational characteristic.

28 Claims, 17 Drawing Sheets

Related U.S. Application Data

(60) Provisional application No. 61/516,609, filed on Apr. 5, 2011, provisional application No. 61/424,575, filed on Dec. 17, 2010.

(51) Int. Cl.
*E21B 47/00* (2012.01)
*E21B 19/10* (2006.01)
*E21B 19/00* (2006.01)
*E21B 19/06* (2006.01)

(52) U.S. Cl.
CPC ..... *E21B 19/165* (2013.01); *E21B 47/00* (2013.01); *E21B 19/06* (2013.01)

(56) References Cited

U.S. PATENT DOCUMENTS

| | | | | |
|---|---|---|---|---|
| 4,676,312 | A | 6/1987 | Mosing et al. | |
| 4,800,968 | A | 1/1989 | Shaw et al. | |
| 4,875,530 | A | 10/1989 | Frink et al. | |
| 5,736,938 | A | 4/1998 | Ruthroff | |
| 5,791,410 | A | 8/1998 | Castille et al. | |
| 5,909,768 | A | 6/1999 | Castille et al. | |
| 6,626,238 | B2 | 9/2003 | Hooper | |
| 6,742,596 | B2 | 6/2004 | Haugen | |
| 6,845,825 | B2 | 1/2005 | Bischel et al. | |
| 6,968,895 | B2 | 11/2005 | Mosing et al. | |
| 7,073,598 | B2 | 7/2006 | Haugen | |
| 7,086,461 | B2 * | 8/2006 | Schulze-Beckinghausen | E21B 19/07 166/77.53 |
| 7,182,133 | B2 | 2/2007 | Webre et al. | |
| 7,322,406 | B2 | 1/2008 | Wiggins et al. | |
| 7,874,352 | B2 | 1/2011 | Odell, II et al. | |
| 7,946,356 | B2 | 5/2011 | Koederitz et al. | |
| 8,051,909 | B2 | 11/2011 | Angelle et al. | |
| 8,733,454 | B2 | 5/2014 | Bouligny et al. | |
| 2005/0247483 | A1 | 11/2005 | Koch et al. | |
| 2005/0269104 | A1 | 12/2005 | Folk et al. | |
| 2006/0011350 | A1 | 1/2006 | Wiggins et al. | |
| 2006/0108113 | A1 | 5/2006 | Scott et al. | |
| 2006/0191690 | A1 | 8/2006 | Severin et al. | |
| 2007/0017682 | A1 | 1/2007 | Abrahamsen et al. | |
| 2007/0124220 | A1 | 5/2007 | Griggs et al. | |
| 2007/0131416 | A1 * | 6/2007 | Odell, II | E21B 19/06 166/250.1 |
| 2008/0149326 | A1 | 6/2008 | Angelle et al. | |
| 2008/0173480 | A1 | 7/2008 | Annaiyappa et al. | |
| 2008/0264648 | A1 | 10/2008 | Pietas et al. | |
| 2009/0151934 | A1 | 6/2009 | Heidecke et al. | |
| 2009/0188675 | A1 * | 7/2009 | Bloom | E21B 15/00 166/381 |
| 2009/0205820 | A1 | 8/2009 | Koederitz et al. | |
| 2009/0242199 | A1 * | 10/2009 | Basmajian | E21B 23/00 166/255.2 |
| 2009/0272542 | A1 | 11/2009 | Begnaud et al. | |
| 2009/0274545 | A1 | 11/2009 | Liess et al. | |
| 2010/0193198 | A1 | 8/2010 | Murray et al. | |
| 2010/0270033 | A1 | 10/2010 | Angelle et al. | |
| 2011/0017474 | A1 | 1/2011 | Pietras et al. | |
| 2011/0226486 | A1 | 9/2011 | Haugen | |
| 2012/0152619 | A1 | 6/2012 | Hofste et al. | |

FOREIGN PATENT DOCUMENTS

| | | | |
|---|---|---|---|
| WO | 1998031914 | | 7/1998 |
| WO | 2000052297 | A2 | 9/2000 |
| WO | 2000052297 | A3 | 9/2000 |
| WO | 2002036927 | A1 | 5/2002 |
| WO | 2004090279 | A1 | 10/2004 |
| WO | 2005121493 | A2 | 12/2005 |
| WO | 2005121493 | A3 | 12/2005 |
| WO | 2007/070805 | A2 | 6/2007 |
| WO | 2011023335 | A1 | 3/2011 |

OTHER PUBLICATIONS

EPO Extended European Search Report dated May 10, 2017, for European Patent Application No. 16204689.0.
Australian Examination Report dated Jul. 31, 2017, for Australian Patent Application No. 2016213717.
Canadian Office Action dated Nov. 27, 2017, for Canadian Patent Application No. 2,955,777.
Canadian Office Action dated Nov. 27, 2017, for Canadian Patent Application No. 2,955,772.
PCT International Search Report and Written Opinion dated Jun. 24, 2013, for International Application No. PCT/US2011/065218.
PCT International Preliminary Report on Patentability dated Jul. 18, 2013, for International Application No. PCT/US2011/065218.
Australian Examination Report dated Jul. 27, 2017, for Australian Application No. 2016213714.
Canadian Office Action dated Mar. 17, 2015, for Canadian Application No. 2,819,155.
Australian Office Action dated May 15, 2015, for Australian Application No. 2011343668.
Canadian Office Action dated Feb. 1, 2016, for Canadian Application No. 2,819,155.
EPO Extended Search Report for European Application No. 11157094.1, dated Apr. 9, 2014.
EPO Extended Search Report for European Application No. 11157091.7, dated Apr. 9, 2014.
EPO Examination Report dated Apr. 20, 2015, for European Patent Application No. 11805345.3.
EPO Examination Report dated Jan. 28, 2016, for EPO Patent Application No. 11805345.3.
Canadian Office Action in related applicaton CA2819,155 dated Jul. 14, 2014.
Brazil Office Action dated Sep. 10, 2019 for Brazilian Patent Application No. BR112013014858-6.

* cited by examiner

ELECTRONIC CONTROL SYSTEM FOR A TUBULAR HANDLING TOOL

CROSS-REFERENCE TO RELATED APPLICATIONS

This application is a divisional application of U.S. patent application Ser. No. 13/327,296, filed Dec. 15, 2011, which claims the benefit of U.S. Provisional Application No. 61/516,609, filed Apr. 5, 2011, and U.S. Provisional Application No. 61/424,575, filed Dec. 17, 2010, each application of which is herein incorporated by reference in its entirety.

BACKGROUND OF THE INVENTION

Field of the Invention

Embodiments of the invention relate to an electronic control system for controlling the operation of one or more tubular handling tools. Embodiments of the invention relate to an electronic interlock for a tubular handling system for performing tubular handling operations.

Description of the Related Art

It is known in the drilling industry to use a top drive system on a drilling rig for rotating a tubular or tubular string for making up or breaking out tubular connections while drilling a well and for installing the casing after the well is drilled. Top drive systems are equipped with a motor to provide torque for rotating the tubulars, and may be equipped with a tubular gripping tool to facilitate the handling of the tubulars. During a tubular makeup/breakout operation, the top drive works in tandem with a spider provided at the rig floor. While handling a string of tubulars suspended from a drilling rig, either the top drive, an elevator attached to the top drive, or the spider must be engaged with the tubular string to prevent the string from falling into the well.

Typically, an operator located on the platform controls the top drive, elevator, and the spider with manually operated levers that control fluid power to the slips that cause the top drive/elevator and spider to retain the tubular string. At any given time, the operator can inadvertently drop the tubular string by moving the wrong lever. Conventional interlocking systems based around hydraulic or pneumatic circuits have been developed and used with elevator/spider systems to address this problem.

There is a need for a more sophisticated interlock system for use with one or more tubular handling tools to prevent inadvertent release of a tubular or tubular string.

SUMMARY OF THE INVENTION

In one embodiment, an electronic control system comprises a first tubular handling tool; a sensor coupled to the first tubular handling tool; and a controller in communication with the sensor. The controller is configured to control actuation of the first tubular handling tool in response to an electronic signal received from the sensor. The electronic signal corresponds to an operational characteristic of the first tubular handling tool. The first tubular handling tool includes at least one of an elevator and a spider. The sensor includes at least one of a strain gauge, a load cell, a torque sub, a pressure transducer, and a potentiometer. The operational characteristic includes at least one of a load that is supported by the first tubular handing tool, a pressure that is supplied to the first tubular handling tool, and a position of the first tubular handling tool. The controller includes at least one of a programmable logic controller and an electronic processing unit. The system further comprises an electronic manifold coupled to the first tubular handling tool for directing the electronic signal from the sensor to the controller. The system further comprises an electronically controlled valve that is actuatable by the controller to prevent or allow pressurized fluid to or from the first tubular handling tool. The system further comprises a second tubular handling tool, and a second sensor that is in communication with the controller, wherein the controller is configured to prevent or allow actuation of the second tubular handling tool in response to an electronic signal received from the second sensor that corresponds to an operational characteristic of the second tubular handling tool. The system further comprises a second electronically controlled valve that is actuatable by the controller to prevent or allow pressurized fluid to or from the second tubular handling tool. The system further comprises a remote control in communication with the controller that is configured to receive data from the controller corresponding to the operational characteristic of the first tubular handling tool.

In one embodiment, an electronic control system comprises a first tubular handling tool; a second tubular handling tool; and an electronic interlock system operable to control actuation of the first and second tubular handling tools. The electronic interlock system includes a first sensor coupled to the first tubular handling tool, a second sensor coupled to the second tubular handling tool, and a controller in communication with the first and second sensors. The sensors are configured to send an electronic signal to the controller that corresponds to an operational characteristic of the tubular handling tools. The controller is configured to actuate a valve to prevent or allow pressurized fluid to or from the tubular handling tools in response to the operational characteristics. The operational characteristics include at least one of a load that is supported by the tubular handing tools, a pressure that is supplied to the tubular handling tools, and a position of the tubular handling tools. The sensors include at least one of a strain gauge, a load cell, a torque sub, a pressure transducer, and a potentiometer. The first tubular handling tool is an elevator and the second tubular handling tool is a spider.

In one embodiment, a method of controlling a tubular handling tool comprises measuring an operational characteristic of the tubular handling tool; communicating the operational characteristic to a controller in the form of an electronic signal; and using the controller to control actuation of the tubular handling tool in response to the measured operational characteristic. The method further comprises sending an electronic signal to a valve to actuate the valve and thereby supply or release fluid pressure to the tubular handling tool. The method further comprises actuating the tubular handling tool by actuating an electronically controlled valve with the controller.

In one embodiment, a tubular handling system comprises a tubular handling tool having a sensor configured to measure an operational characteristic of the tubular handling tool; an electronic control system in communication with the sensor; and a rig winch system in communication with the electronic control system, wherein the rig winch system is operable to raise or lower the tubular handing tool in response to the operational characteristic measured by the sensor and communicated to the electronic control system.

In one embodiment, a tubular handling system comprises an actuation assembly; a gripping tool coupled to the actuation assembly such that the actuation assembly is operable to actuate the gripping tool; a first sensor coupled to the actuation assembly; and an identification device. The first sensor is operable to communicate with the identification device and transmit a signal to an electronic control system corresponding to information regarding the gripping tool. The electronic control system is operable to actuate the actuation assembly to actuate the gripping tool in response to the information.

In one embodiment, a tubular handling system comprises a tubular handling tool having a sensor configured to measure a position of a bail assembly of the tubular handling tool; and an electronic control system in communication with the sensor, wherein the electronic control system is operable to actuate the bail assembly in response to a position measurement that is sent to the electronic control system from the sensor.

In one embodiment, a method of controlling a tubular handling system comprises measuring an operational position of at least one of a gripping assembly, a compensation assembly, and a bail assembly of a tubular handling tool; communicating the operational position to an electronic control system in the form of an electronic signal; and controlling the actuation of at least one of the gripping assembly, the compensation assembly, and the bail assembly using the electronic control system in response to the operational position.

In one embodiment, an electronic control system comprises a first tubular handling tool; a second tubular handling tool; a sensor coupled to the first tubular handling tool; and a controller in communication with the sensor, wherein the controller is configured to control actuation of the second tubular handling tool in response to an electronic signal received from the sensor that corresponds to an operational characteristic of the first tubular handling tool.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
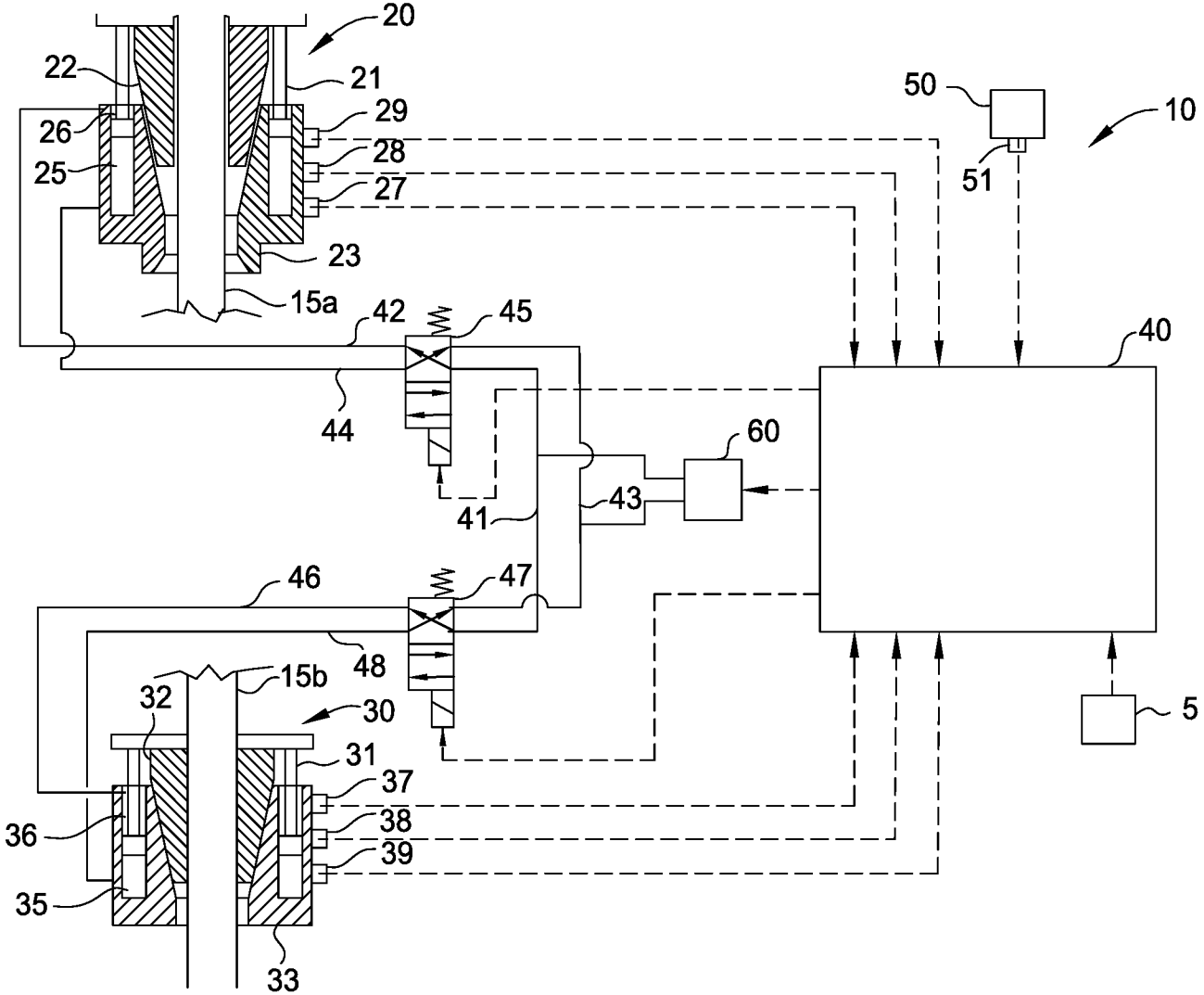
FIGS. 1A and 1B illustrate an electronic control system according to one embodiment.

FIG. 1A illustrates an electronic control system 10 for controlling the operation of a first tubular handling tool 20, such as an elevator or other similar tubular gripping device, and/or a second tubular handling tool 30, such as a spider, to prevent the inadvertent release of one or more tubulars 15*a*, 15*b*. The first and second tubular handling tools 20, 30 may each include at least one piston/cylinder assembly 21, 31, gripping assembly 22, 32, and housing assembly 23, 33 for gripping and supporting tubulars 15*a*, 15*b*. Pressurization of the piston/cylinder assemblies 21, 31 moves the gripping assembly 22, 32 radially inwardly and outwardly to engage and disengage the tubulars 15*a*, 15*b*. A top drive system may be used to rotate the first tubular handling tool 20, to thereby rotate tubular 15*a* and make up or break out a connection with tubular 15*b*, which is supported by the second tubular handling tool 30. In one embodiment, the first tubular handling tool 20 may be an elevator with slips suspended in a derrick. In one embodiment, the first tubular handling tool 20 may be a gripping tool attached to the output shaft of a top drive.

The electronic control system 10 includes a controller 40, such as a programmable logic controller or other electronic processing unit, having a processing unit, a memory, a mass storage device, an input/output control, a power supply, and/or a display unit, that is in communication with one or more sensors 27, 28, 29 attached to the first tubular handling tool 20. The sensors 27, 28, 29 may send one or more electronic signals via wired or wireless communication to the controller 40, the signals corresponding to measured operational characteristics of the first tubular handling tool 20. Similarly, one or more sensors 37, 38, 39 attached to the second tubular handling tool 30 may send electronic signals via wired or wireless communication to the controller 40 regarding the operation of the second tubular handling tool 30. The controller 40 is configured to prevent or allow opening and closing of the tubular handling tools 20, 30 depending on their operational status as measured by the sensors. In particular, the controller 40 is configured to analyze, process, and/or compare the signals received from the sensors to each other and/or to one or more pre-programmed conditions to determine whether to enable actuation of or actuate the first and second tubular handling tools 20, 30. An operator 5 may initiate actuation of the tubular handing tools 20, 30 via the controller 40. The operator 5 may be a person, another controller, or an electronic signal that is sent to the controller 40 from another device, such as a computer. The controller 40 may override, ignore, or follow the operator's command if certain pre-programmed conditions are or are not met, and/or if the controller 40 is receiving signals from the sensors that are or are not in accordance with certain pre-determined conditions with respect to the operational status of the tubular handling tools 20, 30. The controller 40 may be operable to provide an indication that operator's command was overridden, ignored, or followed. The indication may be in the form of an auditory or visual alarm, or an electronic signal, such as a message on a display screen. The electronic control system 10 may thus function as an electronic interlock system between the tubular handling tools 20, 30 as further described herein.

The electronic control system 10 may include first and second valves 45, 47, such as solenoid valves, for directing the supply and release of fluid pressure to and from the tubular handling tools 20, 30. A fluid pressure source 60, such as a hydraulic power unit or an air supply, may be coupled to the valves 45, 47 by a fluid line 41 to supply pressurized fluid to the tubular handling tools 20, 30. Another fluid line 43 may be provided to release fluid pressure from the tools via valves 45, 47. Fluid line 43 also may be coupled to the fluid pressure source 60 to return the fluid to the source and/or to release the fluid pressure from the fluid line 43 into the atmosphere. The controller 40 may send an electronic signal to the valves 45, 47 to actuate the valves into open and closed positions. Optionally, the controller 40 may send an electronic signal to the fluid pressure source 60 to control operation of the supply and return of pressurized fluid to the tubular handling tools 20, 30.

The first valve 45 is configured to selectively direct fluid from the fluid line 41 to one of the fluid lines 42, 44 to supply pressurized fluid to one of chambers 25, 26 of the piston/cylinder assembly 21, to thereby actuate the gripping assembly 22 of the first tubular handling tool 20 to grip or release tubular 15*a*. Simultaneously, pressurized fluid is released from the other one of chambers 25, 26 of the piston/cylinder assembly 21 through the other one of the fluid lines 42, 44 and is directed to the fluid line 43 via the first valve 45 to release or exhaust the pressurized fluid. An electronic signal is sent from the controller 40 to the first valve 45 to actuate the first valve 45 to connect fluid line 41 with one of fluid lines 42, 44 (and thus connect fluid line 43 with the other one of fluid lines 42, 44) depending on whether the tubular handling tool 20 is to be opened or closed, to release or grip the tubular 15*a*. In addition, the controller 40 may send an electronic signal to actuate the first valve 45 to prevent any fluid communication between fluid lines 41, 43 and fluid lines 42, 44. The second valve 47 is operable in the same manner as the first valve 45, with respect to the second tubular handling tool 30. The controller 40 may open or close one or more of the tubular handling tools 20, 30. The operator 5 communicates with the controller 40 to operate the tubular handling tools 20, 30, but the controller 40 electronically controls or determines whether to actuate the tubular handling tools 20, 30 in response to signals received from the sensors and/or one or more pre-programmed conditions. The controller 40 may also control at which time to actuate the tubular handling tools 20, 30.

To determine whether to open or close, or prevent opening or closing, of either of the tubular handling tools 20, 30, the controller 40 receives one or more electronic signals from the sensors 27, 28, 29 and 37, 38, 39, corresponding to the operational status of the tubular handling tools 20, 30. The controller 40 may analyze, process, and/or compare the signals received from the sensors to each other and/or to one or more pre-programmed conditions to determine whether to enable actuation of or actuate the tubular handling tools 20, 30. The controller 40 may continuously monitor the sensors and the signals received from the sensors to track the operational status of the tubular handling tools 20, 30 throughout a tubular handling procedure. Based on the operational status of the tubular handling tools 20, 30 as computed by the controller 40, the controller 40 may automatically and/or upon initiation by the operator 5 control actuation of the tubular handling tools 20, 30 to prevent inadvertent mishandling of a tubular or tubular string.

Figure 2:
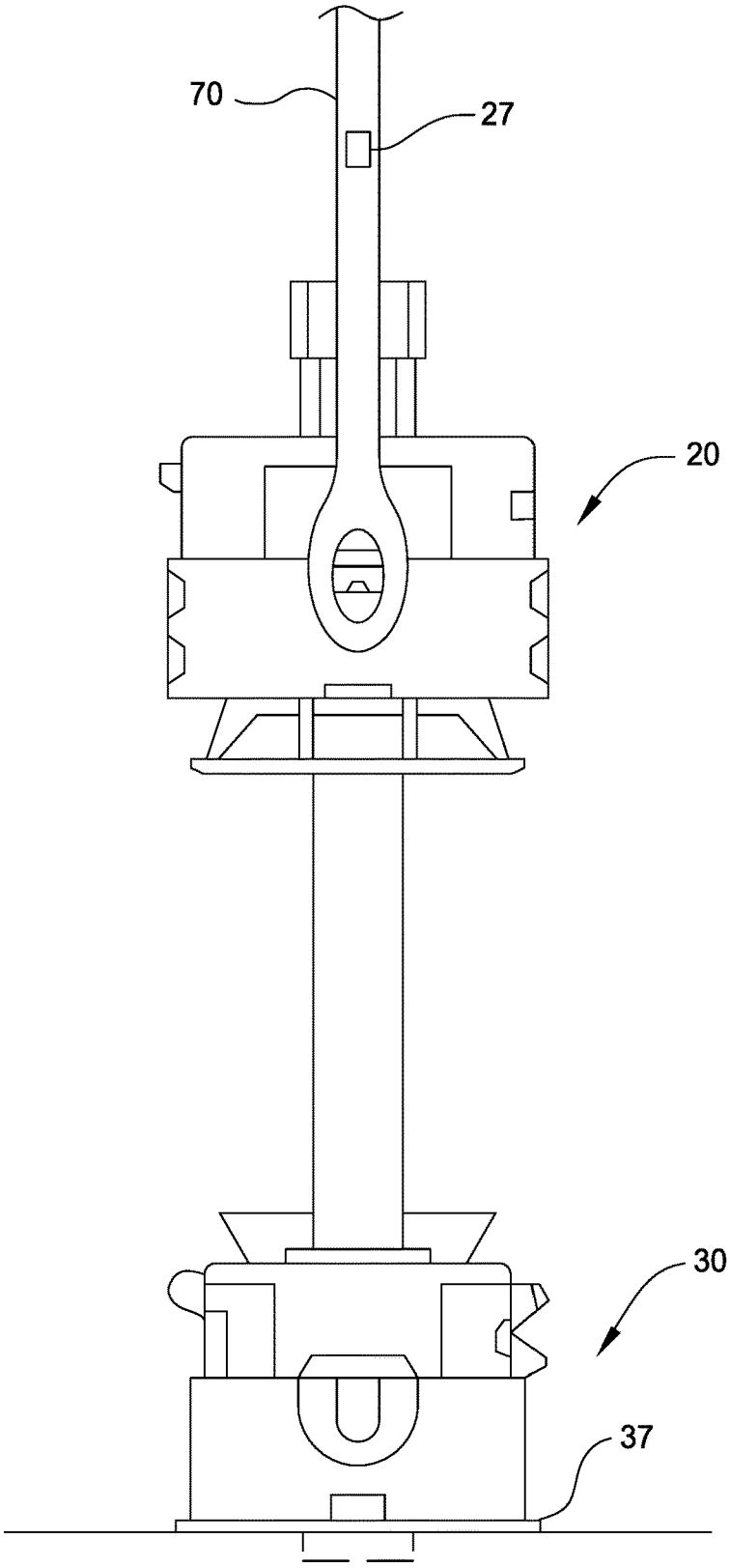
FIGS. 2-5 illustrate one or more sensors of the electronic control system according to one embodiment.

In one embodiment, the sensors 27, 37 may send a signal corresponding to the load being borne by the tubular handling tools 20, 30 or the gripping assemblies 22, 32, thereby indicating whether the tools are supporting at least a portion of the weight of a tubular or tubular sting. The measured load may correspond to the weight of the tubular or tubular string. In one embodiment, the sensors 27, 37 may include strain gauges, compression and tension load cells, a torque sub, and/or other similar load measuring devices. In one embodiment, the sensor 27 may include a torque sub connected between the tubular handling tool 20 and the top drive system that is used to rotate the tool 20. An example of a torque sub that may be used with the embodiments described herein is illustrated in FIG. 4A as item 206 of U.S. Patent Application Publication 2009/0151934, entitled Top Drive System, and filed on Dec. 12, 2008, the contents of which are incorporated herein by reference. As illustrated in FIG. 2, and according to one embodiment, the sensors 27 may include strain gauges that are attached to bails 70, which support the tubular handling tool 20, to measure the weight that the tool is supporting. As further illustrated in FIG. 2, the sensors 37 may include strain gauges or compression load cells that are attached between the tubular handling tool 30 and the rig floor to measure the weight that the tool is supporting. In one embodiment, the sensors 37 may include a digital compression load cell having for example a capacitive measuring system using a non-contacting ceramic sensor mounted inside a load cell body that can be mechanically attached to the tool 30 (one such load cell is manufactured by Eilersen Industrial Sensors). The weight measurements may correspond to the weight of the tools 20, 30, and/or the weight of the tools 20, 30 plus the weight of the tubular or tubular string.

Figure 3:
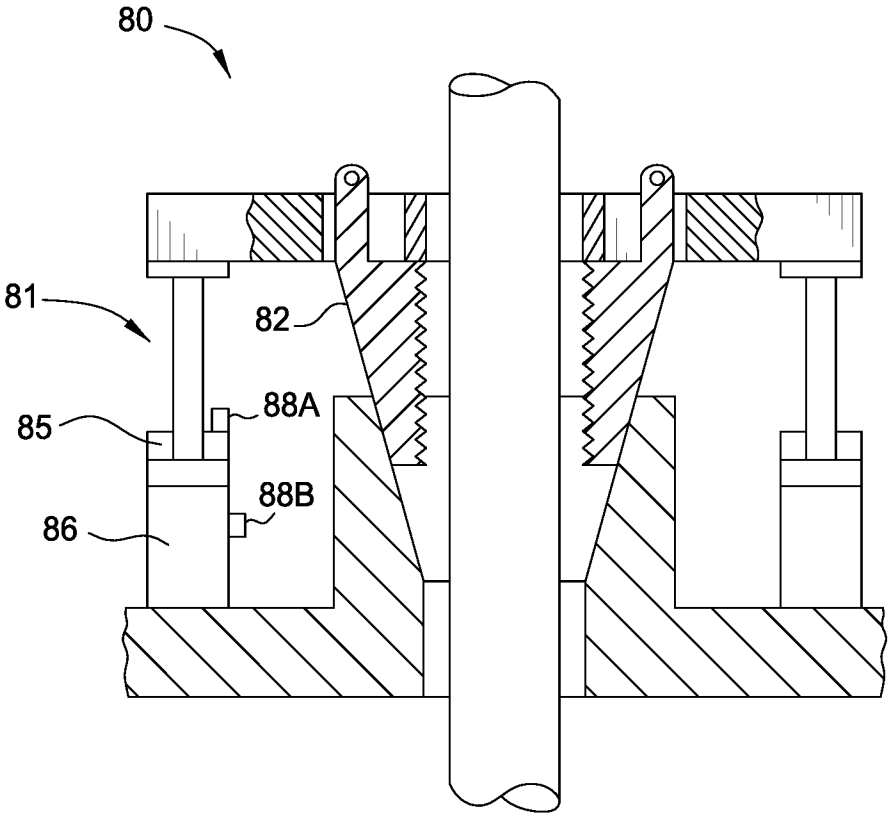

In one embodiment, the sensors 28, 38 may send a signal corresponding to the clamping pressure of the piston/cylinder assemblies 21, 31, thereby indicating whether the gripping assemblies 22, 32 are being forced into a closed (gripping) position. In one embodiment, the sensors 28, 38 may measure the pressure in either of the chambers 25, 26 and 35, 36 of the piston/cylinder assemblies 21, 31. A high pressure measurement in one chamber and a lower pressure measurement in the opposite chamber may indicate the position of the gripping assemblies 22, 32. In one embodiment, the sensors 28, 38 may include pressure transducers or pressure switches. FIG. 3 illustrates a tubular handling tool 80, which may be the same as either tubular handling tools 20, 30, and which includes one or more piston/cylinder assemblies 81 having a first chamber 85 and a second chamber 86, and gripping assemblies 82. Sensors 88*a*, 88*b* illustrate examples of sensors 28, 38, which may include pressure gauges and/or hydraulic load cells to measure the pressures in chambers 85, 86 to indicate whether the gripping assembly 82 is being actuated.

In one embodiment, the sensors 29, 39 may send a signal corresponding to the position of the gripping assemblies 22, 32, thereby indicating whether the tubular handling tools 20, 30 are in an open (release) position or are in a closed (gripping) position. In one embodiment, the sensors 29, 39 may measure the stroke of the piston/cylinder assemblies 21, 31, and/or the stroke of the gripping assemblies 22, 32 to indicate whether the tools 20, 30 are in the open or closed position. In one embodiment, the sensors 29, 39 may measure position, displacement, and/or proximity. In one embodiment, the sensors 29, 39 may include one or more linear transducers, such as potentiometric, ultrasonic, magnetic, inductive, laser, optical, and/or (absolute/incremental) encoder-type sensors. Other similar sensing devices, such as proximity sensors, may be used to measure the stroke, position, displacement, and/or proximity of the piston/cylinder assemblies and/or the gripping assemblies to indicate whether the handling tools 20, 30, 80 are in the open or closed position.

Figure 4:
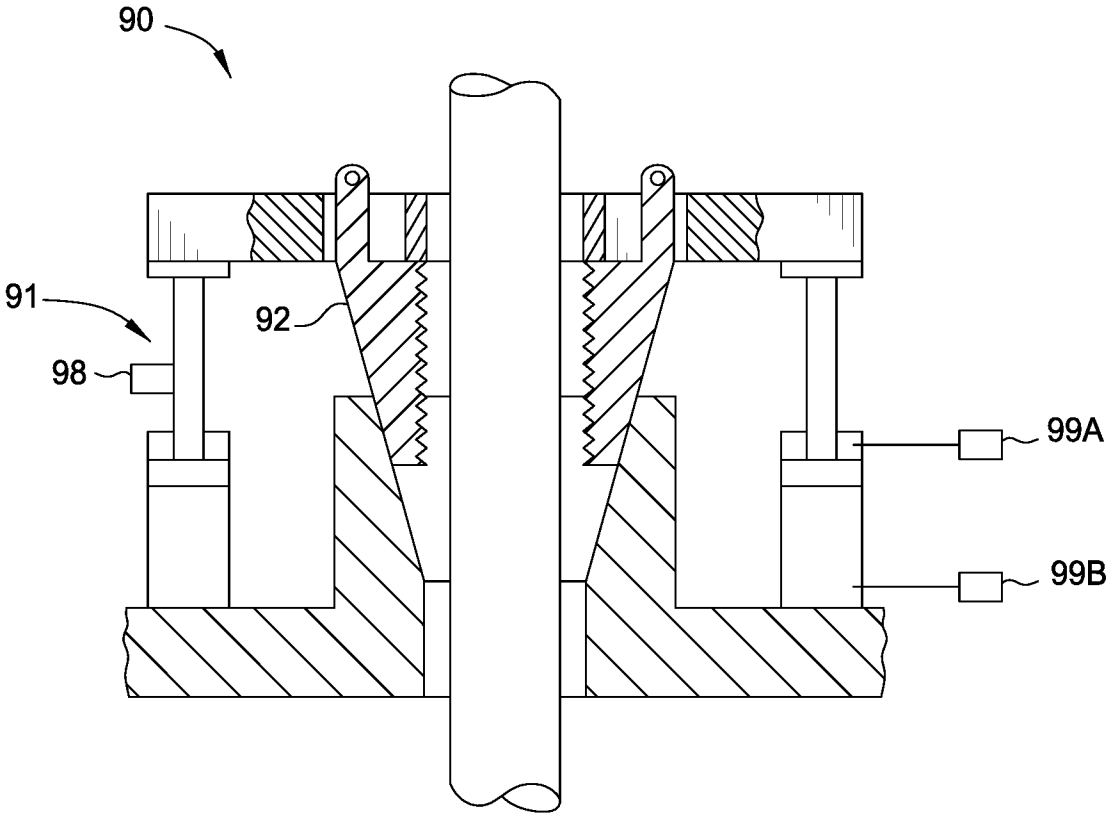

FIG. 4 illustrates a tubular handling tool 90, which may be the same as either tubular handling tools 20, 30, 80 and which includes one or more piston/cylinder assemblies 91 and gripping assemblies 92. Sensor 98 illustrates an example of sensors 29, 39, which may include a potentiometer or other similar sensing device to measure the stroke/displacement/proximity of the piston/cylinder assembly 91 and/or the gripping assembly 92 relative to the sensor 98 or another reference point. Sensors 99A and 99B illustrate an example of sensors 29, 29, which may include flow meters to measure the position of the piston/cylinder assemblies 91 and gripping assemblies 92. In particular, the sensors 99A and 99B may measure an amount of fluid, such as air or oil, supplied into or returned out of the chamber(s) of the piston/cylinder assemblies 91, and communicate an electronic signal corresponding to the measure amount of fluid flow to the electronic control system 10. The electronic control system 10 may compare the measured amount of fluid flow to one or more pre-programmed values to determine whether the piston/cylinder assemblies 91 and gripping assemblies 92 are in an open or closed position. In one embodiment, the pre-programmed valves may be fluid flow amounts that are based on the size of tubular and/or stroke required of the piston/cylinder assemblies 91 and gripping assemblies 92 to grip and release a particular size tubular.

Figure 5:
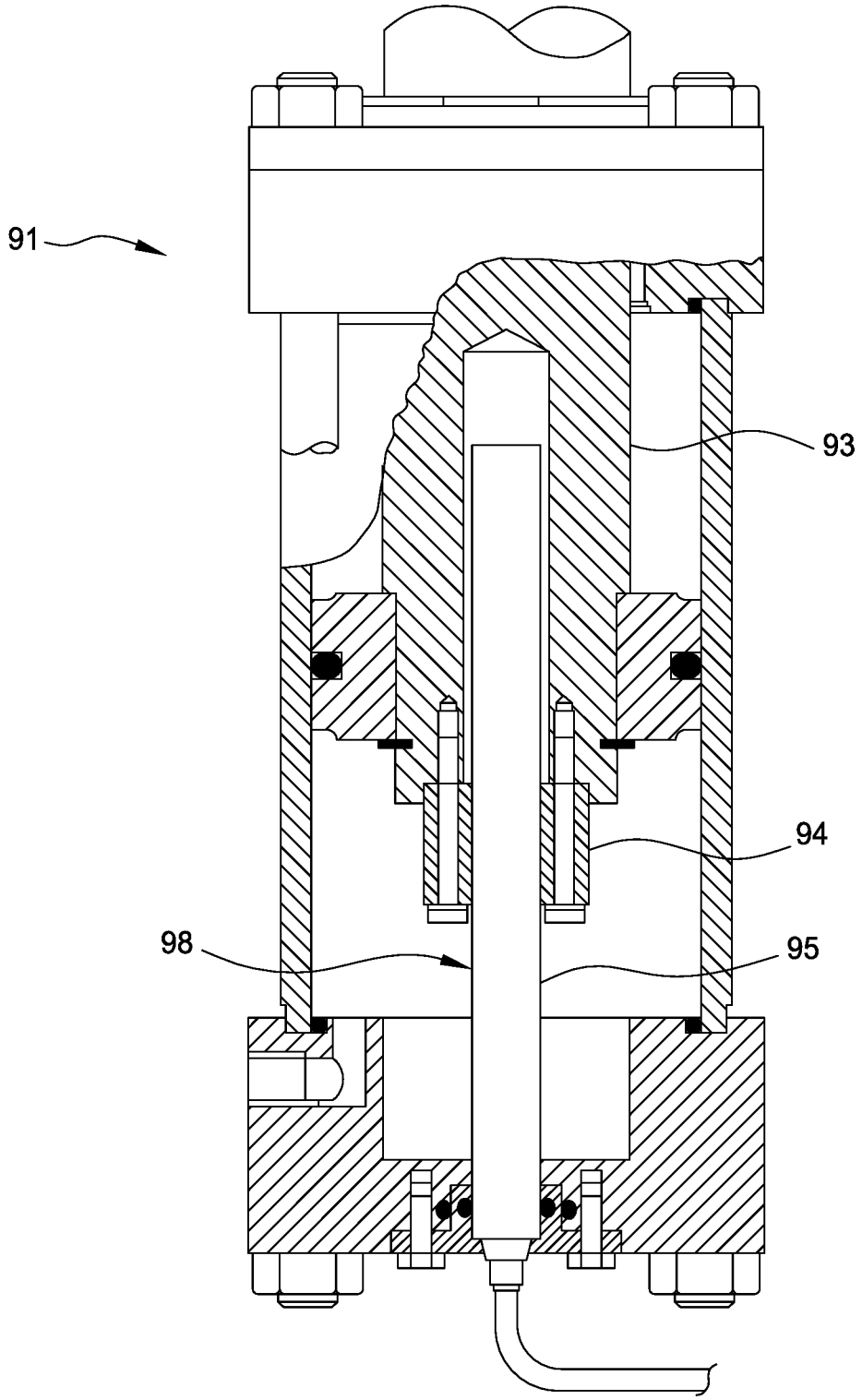

FIG. 5 illustrates the piston/cylinder assembly 91 and a linear potentiometer 98 that is configured to measure the stroke of the assembly. As illustrated, a cylinder shaft 93 moves a cursor 94 relative to the potentiometer body 95 when the piston/cylinder 91 is actuated. An electronic signal corresponding to the position of the cursor 94 relative to the body 95 is sent to the controller 40, which indicates the position of the gripping assembly 92.

In one embodiment, a first sensor may be used to measure the position of the gripping assembly 22, 32 of the tubular handling tool 20, 30 to determine whether the gripping assembly 22, 32 is away from or in contact with a tubular or tubular string. A second sensor may be used to measure the gripping force or pressure being applied to the tubular or tubular string by the gripping assembly 22, 32. A third sensor may be used to measure the weight being borne by the tubular handling tool 20, 30. The combination of the first, second, and third sensor measurements may provide a confirmation that the tubular handling tool 20, 30 is gripping and supporting the tubular or tubular string. The first, second, and third sensors may be any one of the sensors described herein.

In one embodiment, the controller 40 may be in communication with a sensor 51 from a hook load measuring system 50. The measuring system 50 may be attached to a crane, pulley, and/or drawworks system that raises and lowers the tubular handling tool 20. The sensor 51 may send a signal to the controller 40 that indicates the load or weight supported by the tubular handling tool 20, to determine whether the tool is supporting a tubular or tubular string.

In one embodiment, other electronic signals corresponding to the weight measurement of a tubular or tubular string may be generated by other external or third party rig systems, such as a top drive system, a power tong system, or other tubular handling devices, and communicated to the controller 40 to control operation of the tubular handling tools 20, 30. In one embodiment, other electronic signals corresponding to the open and/or closed positions of the tubular handling tools 20, 30 may be generated by other external or third party rig systems and communicated to the controller 40 to control operation of the tools 20, 30. In one embodiment, one or more control lines may be attached to the tubular string while the string is being run into the well. The controller 40 may be in communication with a control line guide assembly of the tubular handling tools 20, 30, or other tubular running device, for protecting the one or more control lines from damage by the gripping assemblies of the tools 20, 30. An example of a control line guide assembly is illustrated in FIG. 7D as item 600 of U.S. Patent Publication 2010/0059231, entitled Method and Apparatus For Supporting Tubulars, and filed on Sep. 10, 2008, the contents of which are incorporated herein by reference. In one embodiment, a sensor attached to the control line guide assembly may send an electronic signal to the controller 40 that corresponds to the position of the control line guide assembly, thereby preventing or allowing actuation of the tools 20, 30. In one embodiment, the sensor may measure whether a rotating door or other protective device of the control guide line assembly is in an open or closed position, which may indicate whether the control lines are secured or exposed to the gripping assembly. Any signal communicated to the controller 40 may be in analog and/or digital forms, and may be sent via wired and/or wireless communication.

In response to one or more of the electronic signals received from the various sensors and/or the operational command by the operator 5, the controller 40 may thus function as an electronic interlock to prevent opening or closing of either of the tubular handling tools 20, 30 and thereby prevent inadvertent dropping or mishandling of tubulars. In one embodiment, the controller 40 may prevent opening (e.g. release of pressure and/or pressurization) of either piston/cylinder assemblies 21, 31 if it is receiving a signal that either of the tubular handling tools 20, 30 are in a closed position, are supporting a load that corresponds to the weight of a tubular, are actuated into the closed position, and/or are otherwise gripping and supporting a tubular or tubular string, while the other tool is not supporting the same. In one embodiment, the controller 40 will only allow the first tubular handling tool 20 to open or release when the tubular or tubular string weight is supported by the second tubular handling tool 30. In one embodiment, the controller 40 will only allow the second tubular handling tool 30 to open or release when the tubular or tubular string weight is supported by the first tubular handling tool 20.

In one embodiment, the controller 40 may be configured to prevent or allow actuation of the tubular handling tools 20, 30 only when it receives an electronic signal corresponding to a particular operational state of either tool 20, 30 from at least one of the sensors, at least two of the sensors, or each one of the sensors on either tool 20, 30. In one embodiment, the controller 40 may be configured to prioritize the signals received from each sensor to determine whether to prevent or allow actuation of the tubular handling tools 20, 30. In one embodiment, the controller 40 may be configured to prioritize the data received from one or more of the sensors. Alternatively, the controller 40 may be configured to give equal priority to the data from two or more of the sensors. The prioritization or equal prioritization may be from the sensors of one or both tools 20, 30. For example, if both tools 20, 30 are closed around the tubular string, and it is desired to open the spider, priority may be give to the data from the sensors associated with the elevator which measure string weight. In one embodiment, the electronic control system 10 may include a manual override feature to manually override the controller 40 at any time during a tubular handling operation to allow the operator 5 to directly actuate the tubular handling tools 20, 30 into an open or closed position.

In one embodiment, the controller 40 may be configured to prevent or allow actuation of the tubular handling tools 20, 30 when it receives a signal that corresponds to a measurement within a pre-determined operational range. The controller 40 may be pre-programmed with acceptable sensor data ranges according to the equipment being used and the tubulars being handled. In one embodiment, a signal corresponding to a load and/or pressure measurement may be within a pre-determined load and/or pressure range for the controller 40 to prevent or allow actuation of the tubular handling tools 20, 30. In one embodiment, a signal corresponding to a position of the piston/cylinder assembly may be within a pre-determined range of distance for the controller 40 to prevent or allow actuation of the tubular handling tools 20, 30. In one embodiment, the controller 40 may be pre-programmed with acceptable positions or ranges of positions of the gripping (slip) assembly. Upon receiving a signal corresponding to the position of the gripping assembly from the sensors, the controller 40 may compare the measured position to the pre-programmed acceptable positions to determine whether to prevent or allow actuation of the tools 20, 30. In one embodiment, the controller 40 may be pre-programmed with acceptable values or ranges of values for comparison with the data received from the sensors.

In one embodiment, the electronic control system 10 may be configured as an electronic interlock system for only one of the tubular handling tools 20, 30. The system 10 may include the first or second tubular handling tool 20, 30, the controller 40, and at least one sensor (e.g. sensors 27, 28, 29, 37, 38, 39). The controller 40 may actuate either valve 45, 47 (depending on the tool being controlled) to prevent or allow actuation of the tool based upon the signal received from the sensor. In one embodiment, the electronic control system 10 may be configured as an electronic interlock system for only one of the tubular handling tools 20, 30 but may receive measured data from sensors on both tubular handling tools 20, 30. In one embodiment, one of the tubular handling tools 20, 30 may be manually operated, while the other tool is interlocked by the controller 40. The operational status of one of the tools 20, 30 may be manually input into the controller 40, while the status of the other tool is measured by the sensors.

Figure 1B:
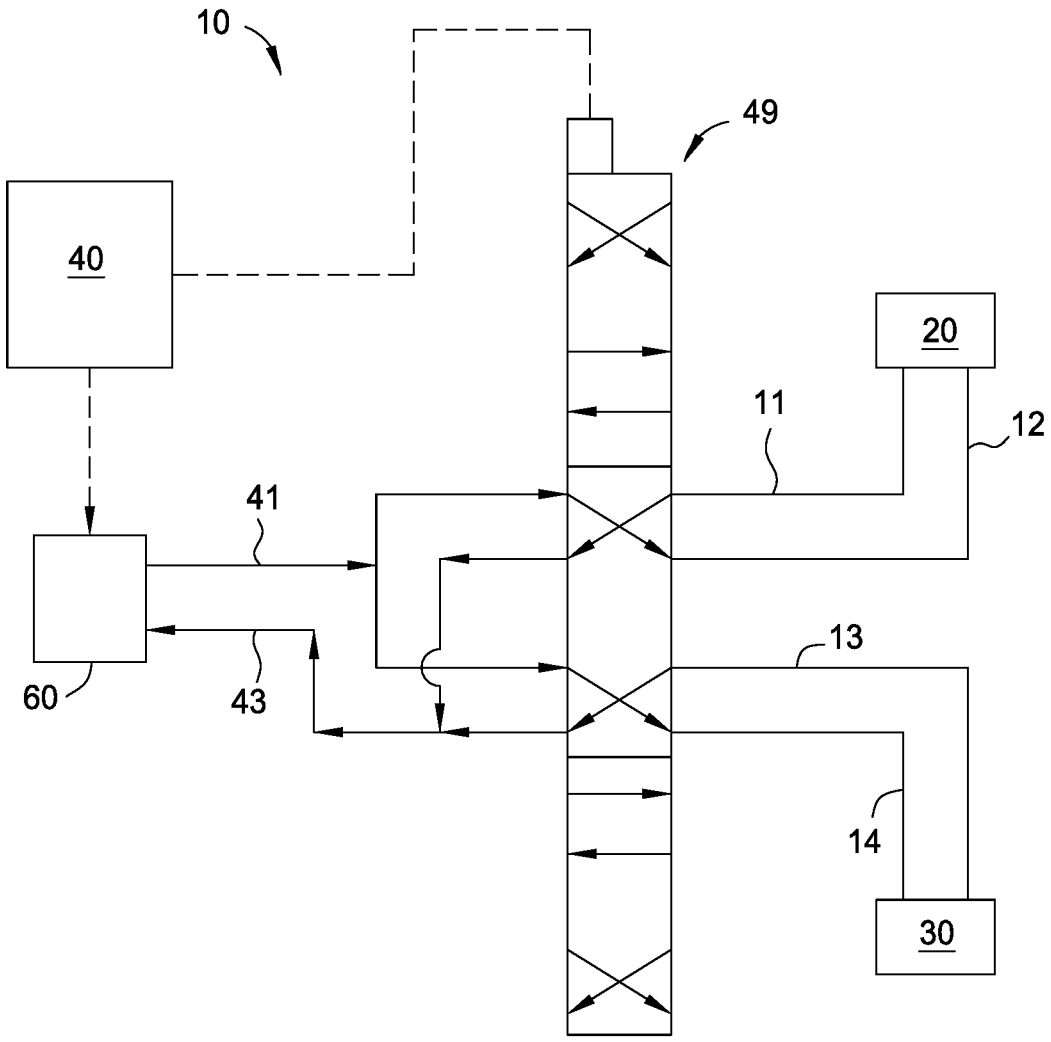

FIG. 1B illustrates the electronic control system 10 according to one embodiment. In particular the first and second valves 45, 47 have been combined into a single electronically controlled valve 49 that supplies pressurized fluid from the fluid source 60 to the first (upper gripping) and second (lower gripping) tubular handling tools 20, 30. The valve 49 may be actuated by the controller 40 into a first position to close the first tubular handling tool 20, such as via fluid line 11, and open the second tubular handling tool 30, such as via fluid line 14. The valve 49 also may be actuated by the controller 40 into a second position to close both of the tubular handling tools 20, 30, such as via fluid lines 11, 13, respectively. The valve 49 also may be actuated by the controller 40 into a third position to open the first tubular handling tool 20, such as via fluid line 12, and close the second tubular handling tool 30, such as via fluid line 13. In the event of a power outage, the valve 49 may be configured to move into a fail-safe or default position, such as the second position to close both tools 20, 30. In one embodiment, the valve 49 may be biased by a spring or other means into the fail-safe/default position.

In one embodiment, a method of operation of the electronic control system 10 may begin with the first tubular handling tool 20 supporting a first tubular, a corresponding load measurement of which is sent to the controller 40 via one or more sensors described above. The first tubular handling tool 20 may be used to lower the first tubular into the second tubular handling tool 30. The operator 5 may communicate to the controller 40 to actuate the second tubular handling tool 30, and thereafter actuate the first tubular handling tool 20 to transfer the first tubular from the first to the second tubular handling tool 30. The controller 40 may actuate the second tubular handling tool 30 to grip the first tubular, while preventing release of the first tubular by the first tubular handling tool 20. The first tubular handling tool 20 may then be lowered until the measured load indicates that the weight of the first tubular is being supported by the second tubular handing tool 30 and/or is not being supported by the first tubular handling tool 20. The controller 40 may then actuate the first valve 45 to allow actuation of the first tubular handling tool 20 into an open position to release the first tubular. The controller 40 may also prevent actuation of the second tubular handling tool 30 because the controller 40 is receiving signals corresponding to the weight of the first tubular being supported by the tool 30. The first tubular handling tool 20 may then engage a second tubular and support it above the first tubular, which is held by the second tubular handling tool 30. The load measurement of the second tubular is sent to the controller 40 to prevent inadvertent opening of the first tubular handling tool 20. The first and second tubulars may be joined by rotation of at least one of the tubulars via a top drive, a power tong assembly, and/or the tubular handling tools 20, 30. After the tubulars are joined to form a tubular string, the first tubular handling tool 20 may be raised to lift the tubular string. When the measured weight of the tubular string is signaled to the controller 40 as being supported by the first tubular handling tool 20 and/or upon the command of the operator 5, the controller 40 may then actuate the second valve 47 to allow actuation of the second tubular handling tool 20 into an open position to release the tubular string. The first tubular handling tool 20 may then lower the tubular string through the second tubular handling tool 30, and the controller 40 may allow actuation of the second tubular handling tool 30 to grip the tubular string, while preventing inadvertent release of the tubular string by the first tubular handling tool 20. The first tubular handing tool 20 may then release the tubular string as stated above, and move to engage a third tubular. This process may be repeated to make up the tubular string, and may be reversed to break out the tubular string.

Figure 6:
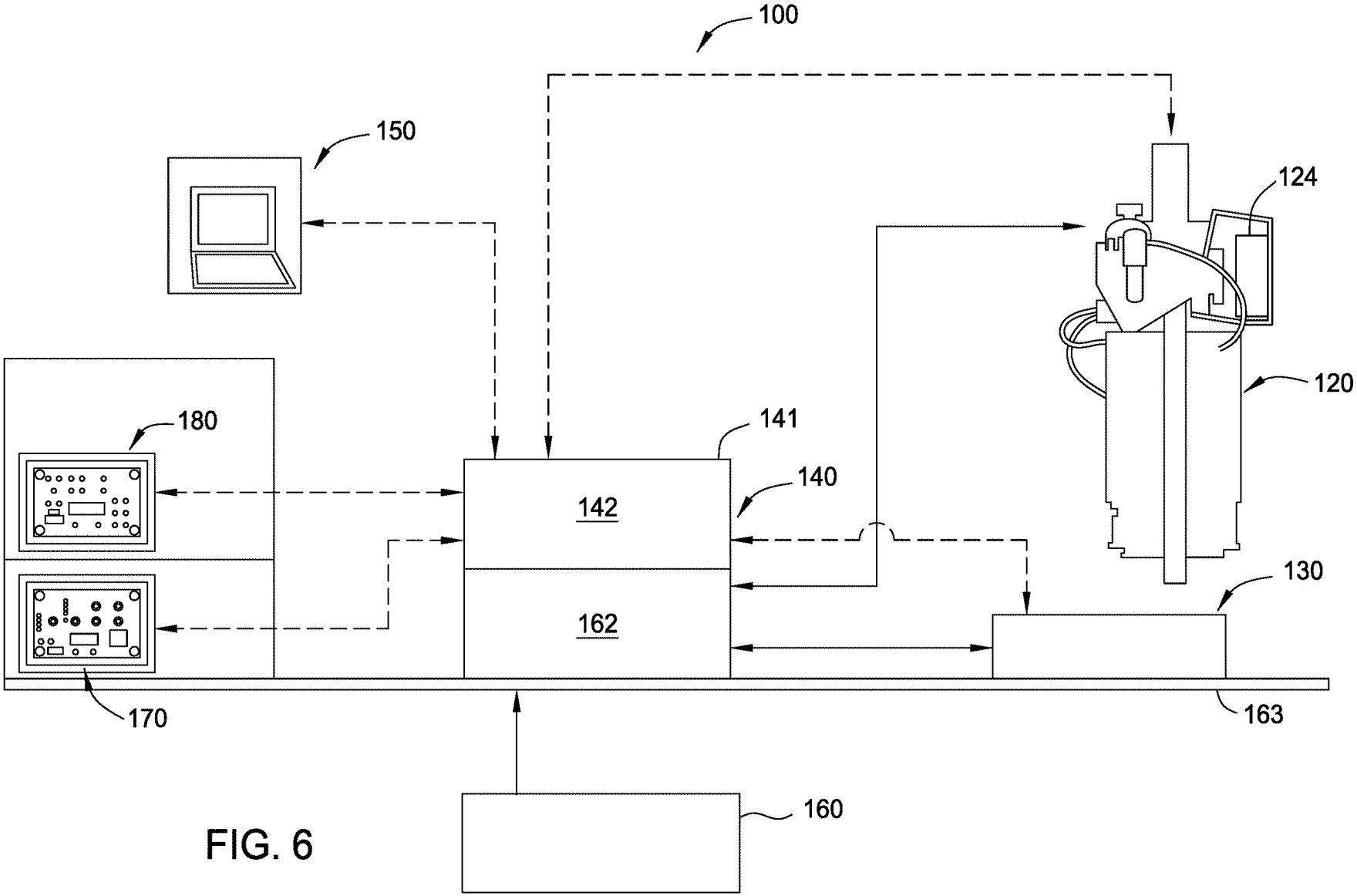
FIG. 6 illustrates the electronic control system according to one embodiment.

FIG. 6 illustrates an electronic control system 100 according to one embodiment. The electronic control system 100 includes at least a first tubular handling tool 120, such as the tubular handling tool 20, a control assembly 140, and an operator remote control 170. Also illustrated is a second tubular handling tool 130, such as the tubular handling tool 30 (e.g. a spider), a fluid pressure source 160, such as a hydraulic or pneumatic power unit, a logging system 150, and a driller remote control 180. The electronic control system 100 may operate similar to the electronic control system 10 described above. An operator may communicate with the control assembly 140 via the operator remote control 170 to operate the tubular handling tool 120 during a tubular handling operation. The control assembly 140 is programmed as an electronic interlock to determine whether to actuate the tubular handling tool 120 and/or any other tubular handling tools that are in communication with the control assembly 140 to prevent mishandling of a tubular or tubular string.

In one embodiment, one or more sensors may be attached to the piston/cylinder assembly of the first tubular handling tool 120. The sensors are in communication with an electronic manifold 124, such as a junction box, that is also attached to the first tubular handling tool 120. The electronic manifold 124 sends electronic signals received from the sensors to a controller 142 (also illustrated in FIG. 7), such as controller 40, disposed within the control assembly 140. The electronic signals may correspond to the position or amount of stroke of the piston/cylinder assembly of the tool 120. Based on the position or amount of stroke, the controller 142 is configured to actuate one or more electronically controlled valves 162, which may also be disposed within the control assembly 140, to supply and/or return fluid and thereby actuate the piston/cylinder assembly of the first tubular handling tool 120. Actuation of the piston/cylinder assembly will actuate the tool 120 to grip or release a tubular. One or more sensors, such as pressure switches/transducers, are attached to a fluid line that supplies and/or returns fluid to and from a piston/cylinder assembly of the second tubular handling tool 130. The sensors send electronic signals to the controller 142, which correspond to the pressure measured in the fluid line. In response to the pressure measurements, the controller 142 is configured to actuate one or more electronically controlled valves 162, which may also be disposed in the control assembly 140, to supply and/or return fluid to actuate the piston/cylinder assembly of the second tubular handling tool 130. Actuation of the piston/cylinder assembly will actuate the tool 130 to grip or release a tubular.

The controller 142 is supported in a housing 141 that may be positioned on the rig floor 163 adjacent to the tubular handling tools 120, 130 or at any other convenient location. As stated above, the controller 142 receives electronic signals from the sensors attached to the tools 120, 130. The controller 142 is programmed to process the data received from the electronic signals and determine whether to prevent or allow actuation of the tubular handling tools 120, 130 during a tubular handling operation. In this manner, the controller 142 can automatically prevent inadvertent opening and/or closing of either tubular handling tool 120, 130.

An operator remote control 170 may be provided so that an operator may communicate with the controller 142 via a wired or wireless connection, radio frequency for example. The operator remote control 170 may be configured to retrieve and display the data sent to the controller 142 by the sensors. The operator remote control 170 may also be configured to program the controller 142 with one or more tubular handling operation parameters so that the controller 142 can automatically control the tubular handling tools 120, 130 as necessary during the tubular handling operations.

A driller remote control 180 may also be provided so that an operator or driller may communicate with the controller 142 via a wired or wireless connection, radio frequency for example. The driller remote control 180 may be configured to retrieve and display the data sent to the controller 142 by the sensors. The driller remote control 180 may be used to confirm and track the positions and operations of the tubular handing tools 120, 130 so that the operator or driller may operate the top drive, rig winch, and other components on the rig to conduct the tubular handling operations.

A logging system 150 may be provided to communicate with the controller 142 via a wired or wireless connection. The logging system 150 may be configured to retrieve, analyze, compare, display, and store the data sent to the controller 142 by the sensors. The logging system 150 may log the actions of the tubular handing tools 120, 130 for each tubular handling operation. In one embodiment, the logging system 150 may be integrated with the controller 142. In one embodiment, the logging system 150 and/or the controller 142 may be configured to record data for the make up and break out of each tubular connection. The recorded data can be used for post-job evaluation and system diagnostic purposes.

Figure 7:
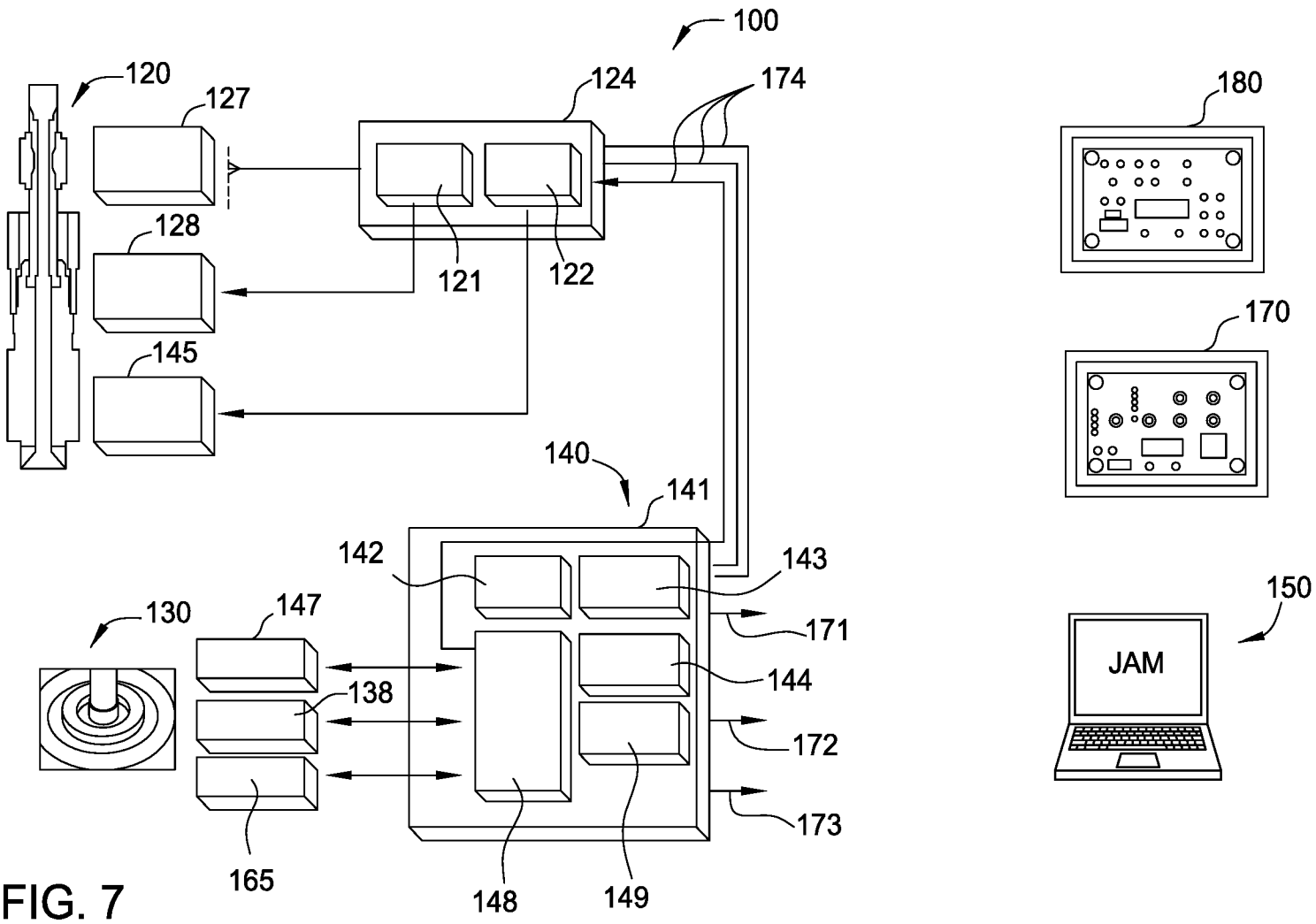
FIG. 7 illustrates the electronic control system according to one embodiment.
Figure 8A:
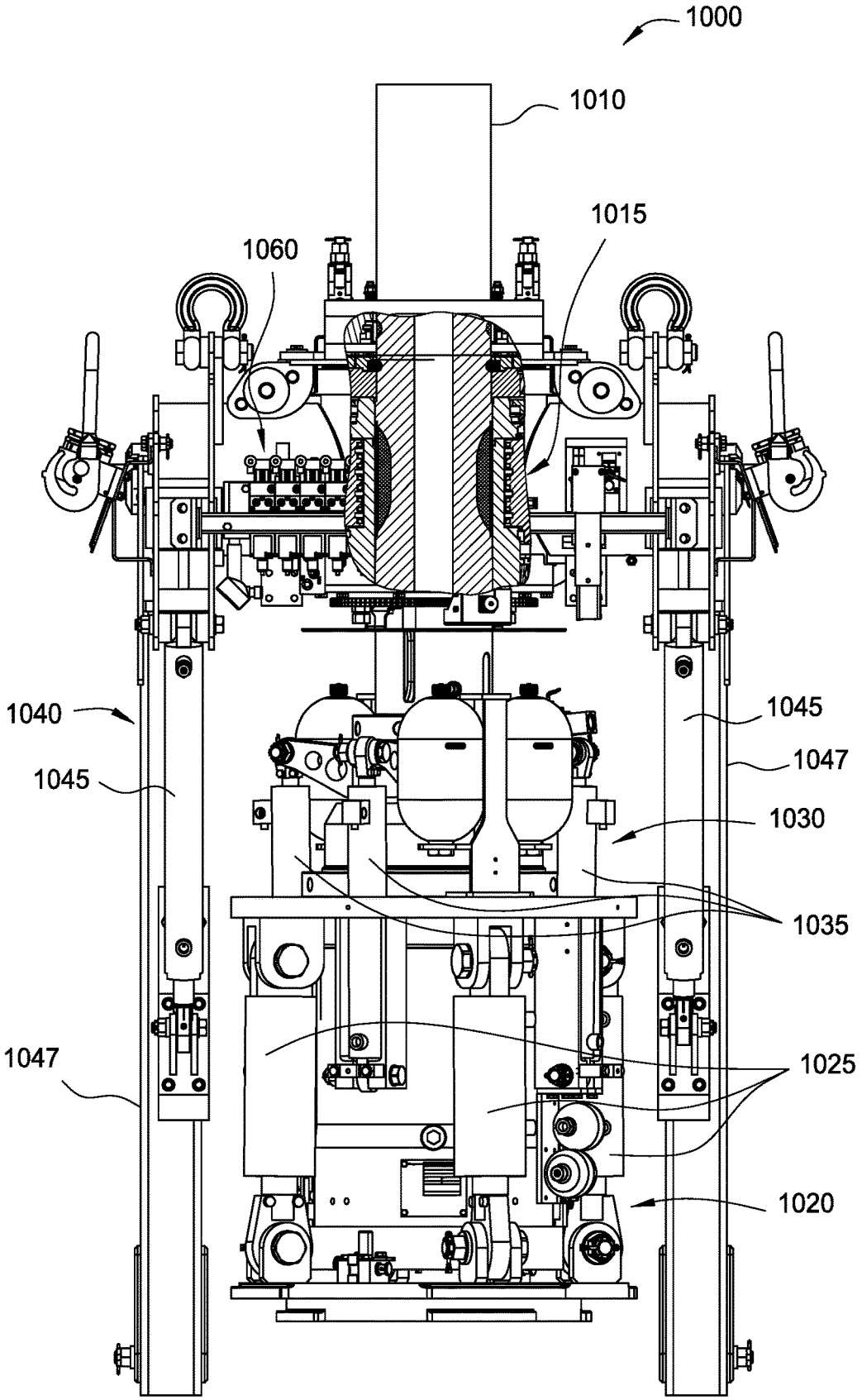
FIGS. 8A-8C illustrate side and top views of a tubular handling system according to one embodiment.
Figure 8B:
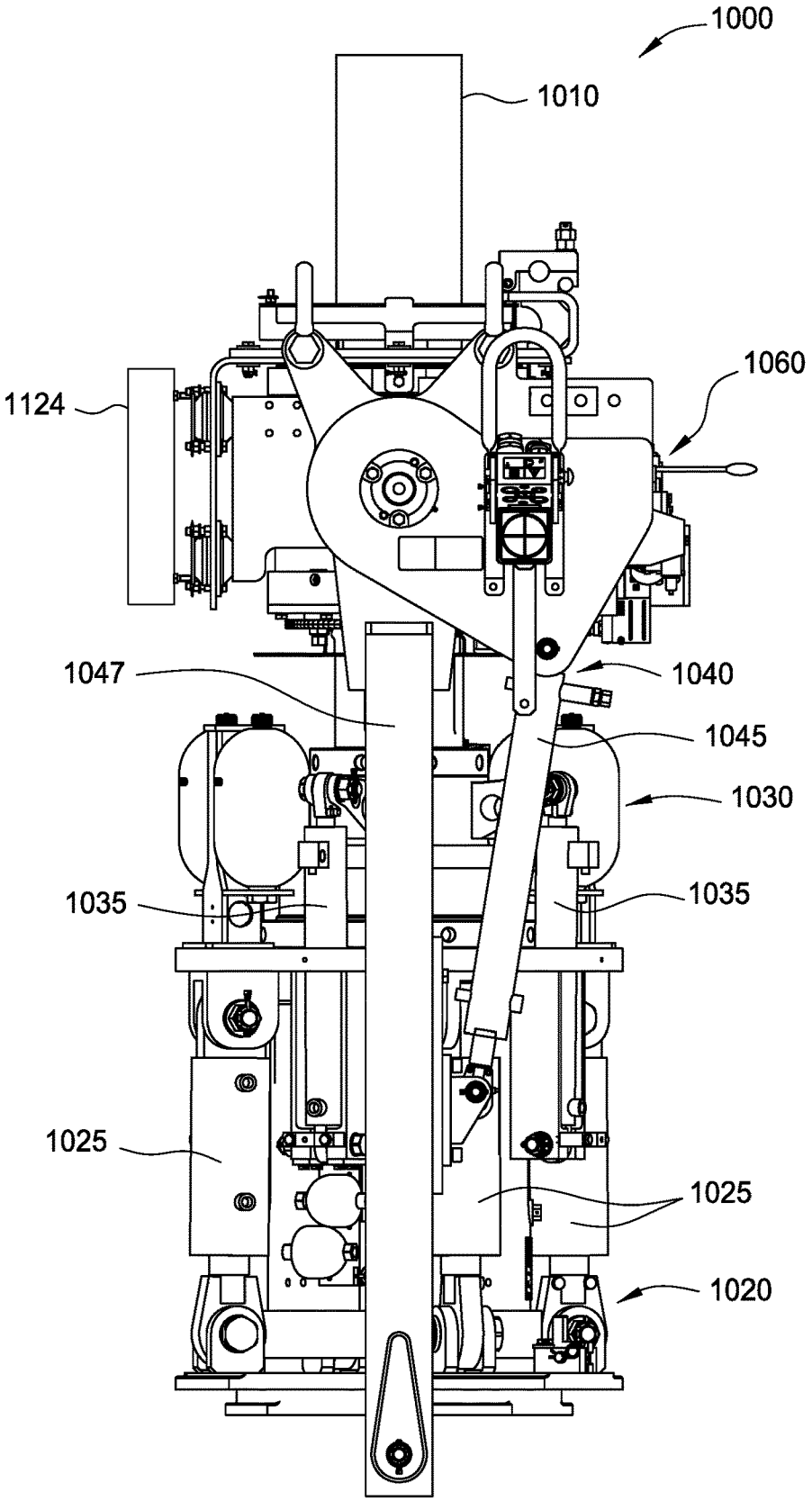
Figure 8C:
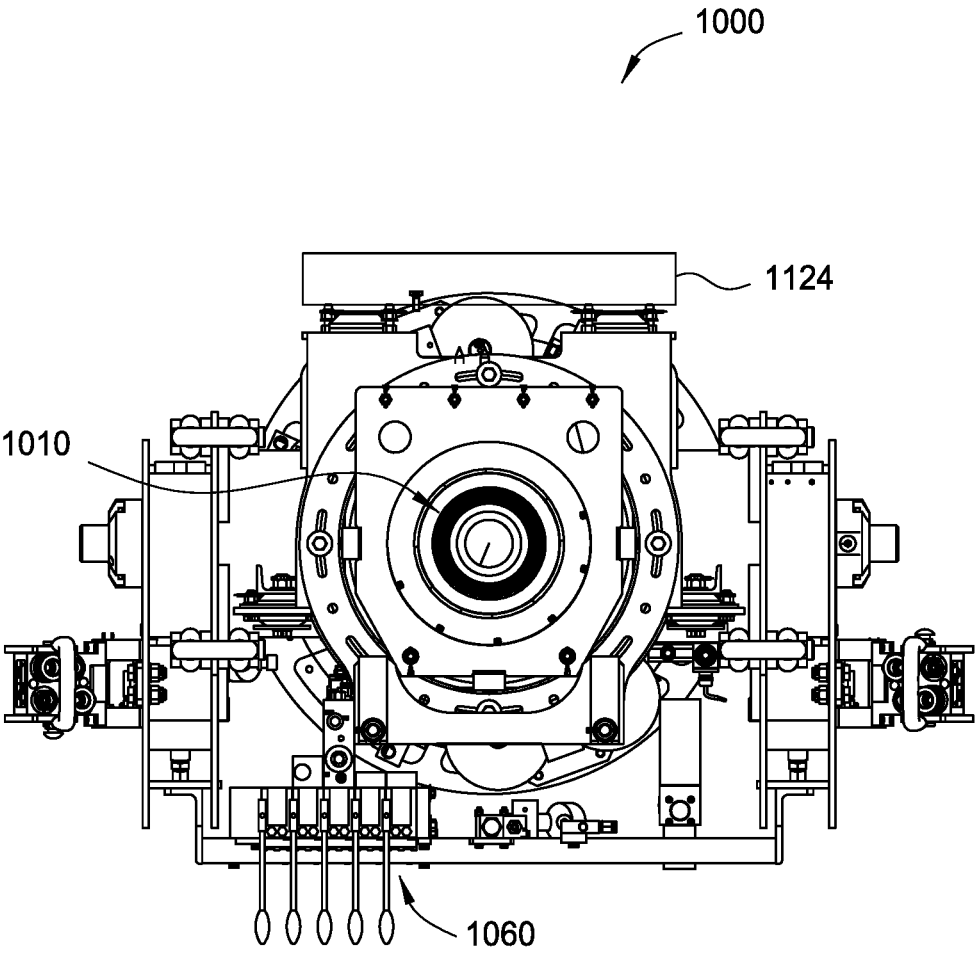
Figure 8H:
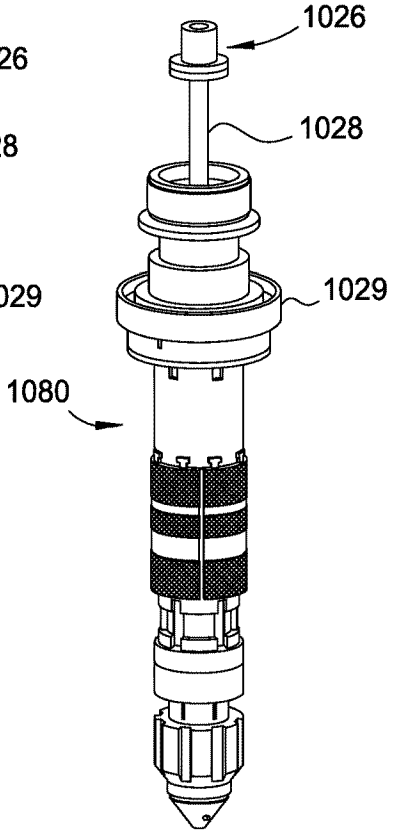
FIGS. 8D-8H illustrate the tubular handling system and gripping tools for use with the tubular handling system according to one embodiment.
Figure 8G:
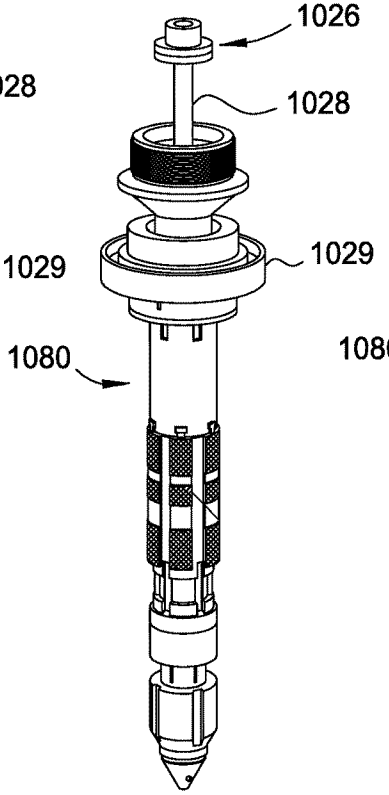
Figure 8F:
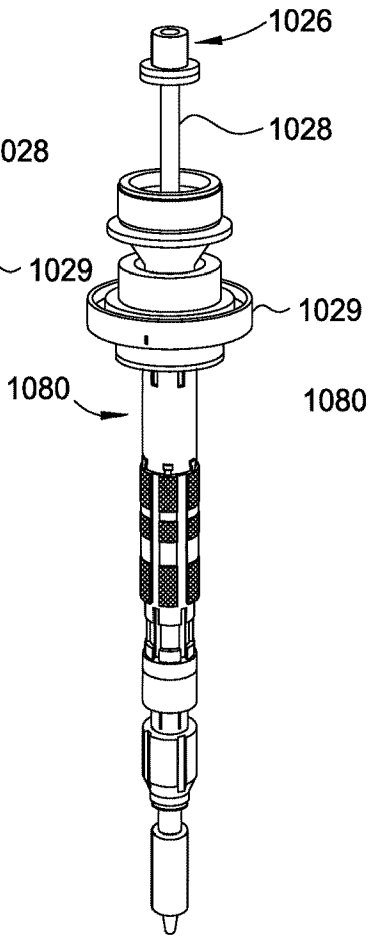
Figure 8E:
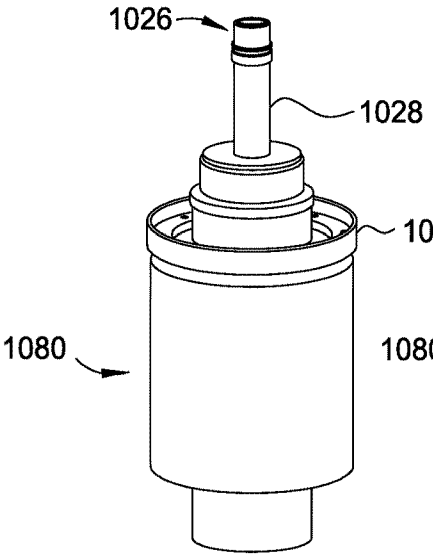

FIG. 7 illustrates the electronic control system 100 according to one embodiment. As illustrated, one or more sensors 127, 128 may be attached to the first tubular handling tool 120. The sensors 127 may be attached to rotating components of the tool 120, and the sensors 128 may be attached to fixed components of the tool 120, the components including bails, a bail housing, a swivel, mandrels, a torque sub, a fill-up tool, a piston/cylinder assembly, a gripping assembly, etc. The sensors 127, 128 may communicate with a module 121 of the electronic manifold 124 via wired or wireless communication (e.g. communication lines 174) to send electronic signals to a module 148 and the controller 142 of the control assembly 140. The sensors 127, 128 may be arranged to measure the load in the first tubular handling tool 120, and/or the position of a gripping assembly and a piston/cylinder assembly of the first tubular handling tool 120. The sensors 127, 128 and the first tubular handling tool 120 may be the same type of sensors (e.g. 27, 28, 29) and tools (e.g. 20) as discussed above. FIGS. 8A-8C illustrate side and top views, respectively, of a tubular handling system 1000 that may be used with the electronic control system 100 according to one embodiment.

The electronic manifold 124 may be powered by a power source 143 that is disposed within the housing 141 of the control assembly 140. The power source 143 may also provide power to the other components of the assembly, including the controller 142, the module 148, a network switch 144, and a receiver 149. The components of the electronic manifold 124 and the control system 140 may be intrinsically safe and/or stored in explosion/flame proof housings to prevent sparks or any type of energy release that can cause an ignition.

One or more sensors 138 may be attached to the second tubular handling tool 130, and may also communicate with the module 148 via wired or wireless communication to send electronic signals to the controller 142. The sensors 138 may be arranged to measure the load in the second tubular handling tool 130, and/or the position of a gripping assembly and a piston/cylinder assembly of the second tubular handling tool 130. The sensors 138 and the second tubular handling tool 130 may be the same type of sensors (e.g. 37, 38, 39) and tools (e.g. 30) as discussed above.

An operator may initiate operation of either tubular handling tool 120, 130 via the controller 142 during a tubular handling operation. However, based on the measurements received from the sensors 127, 128, 138, the controller 142 is programmed to determine whether to actuate the first and second tubular handling tools 120, 130, such as by preventing or allowing the supply/return of pressurized fluid to and from the first and second tubular handling tools 120, 130. In particular, the controller 142 may send an electronic signal to a first valve 145, via a valve drive 122 of the electronic manifold 124, to thereby open or close the first valve 145. In one embodiment, the first valve 145 may include a valve block and one or more solenoid valves arranged to open and close fluid communication to various components of the tool 120, such as the piston/cylinder assembly. The first valve 145 may open or close one or more fluid lines connected to the first tubular handling tool 120 to thereby actuate the tool to grip or release a tubular. Depending on the position of the valve 145, pressurized fluid may be supplied to and/or returned from the first tubular handling tool 120 to actuate it into an open or closed position. Similarly, the controller 142 may send an electronic signal to a second valve 147, via module 148, to thereby open or close the second valve 147. In one embodiment, the second valve 147 may include a valve block and one or more solenoid valves arranged to open and close fluid communication to various components of the tool 130, such as the piston/cylinder assembly. The second valve 147 may open and/or close one or more fluid lines connected to the second tubular handling tool 130 to thereby actuate the tool to grip or release a tubular. Depending on the position of the valve 147, pressurized fluid may be supplied to and/or returned from the second tubular handling tool 130 to actuate it into an open and closed position. The controller 142 operates as an electronic interlock to prevent the inadvertent opening and closing of either tubular handling tool 120, 130 based on the measured operational characteristics of the tools by the sensors.

Pressurized fluid may be supplied to the tubular handling tools 120, 130 from a fluid pressure source, such as fluid pressure source 160 shown in FIG. 6. The pressurized fluid source may be open and closed by a main valve 165, such as a solenoid valve, which is also in communication with the controller 142 via module 148. The controller 142 may also control actuation of the first and second tubular handling tools 120, 130 by sending an electronic signal to open and close the main valve 165.

The operator remote control 170 and the driller's remote control 180 may each be provided to allow the operator to communicate with the control assembly 140, and allow the control assembly 140 to communicate with the operator, via wired or wireless communication 171. The remote controls 170, 180 may be configured to retrieve and display the information sent to the controller 142 by the sensors. In one embodiment, the operator remote control 170 may also be configured to send data to and program the controller 142 with one or more tubular handling operation parameters so that the controller 142 can automatically control operation of the tubular handling tools 120, 130. In one embodiment, a driller may use the driller's remote control 180 to confirm and track the positions and operations of the tubular handing tools 120, 130 so that the driller may operate the top drive, rig winch, and other components on the rig to conduct the tubular handling operations. The remote controls 170, 180 may communicate with the control assembly 140 using the network switch 144, the receiver 149, and/or other communication methods known in the art.

For example, an operator may send a signal to the controller 142 with the remote control 170 to open the main valve 165 to actuate the first and/or second tubular handling tools 120, 130. However, based on the measured signals received from the sensors 127, 128, 138, the controller 142 may be programmed to prevent or allow the flow of pressurized fluid to and/or from the tubular handling tools 120, 130 via the first and second valves 145, 147 to prevent mishandling or dropping of a tubular or tubular string. If the operator initiates opening of the first tubular handing tool 120 manually or remotely, via the operator remote control 170 for example, and the controller 142 is receiving signals from the sensors 127, 128, 138 that the first tubular handling tool 120 is supporting a weight corresponding to the tubular or tubular string, and that the second tubular handling tool 130 is not supporting any load or is in an open position, then the controller 142 would actuate or maintain the first valve 145 to prevent supply or return of fluid with the first tubular handling tool 120. The driller may use the driller's remote control 180 to confirm whether the tubular handling tools 120, 130 are in an open or closed position prior to initiating another action, such as rotating, raising, and/or lowering the first tubular handling tool 120.

Optionally, one or more logging systems 150 may be provided to communicate with the control system 140 via wired or wireless communication 172 to retrieve, analyze, compare, display, and store the information sent to the controller 142 by the sensors. The logging systems 150 may log the actions of the tubular handing tools 120, 130 for each tubular handling operation, such as the loads supported by the tools, the operational status of the tools, the torque applied to the tools and the tubulars, etc. The actions are measured by one or more sensors connected to the tools 120, 130 or connected to other rig components that can be used to measure the various operational characteristics. Each of the sensors may be in communication with the control system 140.

In one embodiment, the control system 140 may be configured to communicate with a top drive system that is used to support (e.g. secure, rotate, raise, lower) the first tubular handling tool 120. Information relating to the operational status of the tubular handling tools 120, 130 may be communicated between the control system 140 and the top drive system via wired or wireless communication 173. The controller 142 may use electronic signals received from the top drive system that correspond to the load supported by the top drive system, the rotational state (speed and/or torque) of the top drive system, and/or the height of the top drive system relative to the tools 120, 130 and the rig floor, to prevent or allow opening and/or closing of the tools 120, 130 to prevent inadvertent mishandling of a tubular or tubular string. In one embodiment, the controller 142 may be used to control the top drive system, such as by preventing, allowing, or initiating operation of the top drive system. In one embodiment, the remote controls 170, 180 may be used to control the top drive system via the control system 140.

FIGS. 8A-8C illustrate side and top views of a tubular handling system 1000 according to one embodiment. The tubular handling system 1000 may include a drive shaft 1010, a gripping assembly 1020 for actuating one or more gripping tools (as illustrated in FIGS. 8E-8H for example), a compensation assembly 1030, and a bail assembly 1040. An electronic manifold 1124 (e.g. a junction box), such as electronic manifold 124 as illustrated in FIGS. 6 and 7, may be coupled to the tubular handling system 1000 for communication between sensors for measuring the operational characteristics of the system 1000 and an electronic control system, such as electronic control systems 10, 100 as illustrated in FIGS. 1A, 6, and 7. A hydraulic manifold 1060 having one or more input and output valves provide communication to a hydraulic supply to actuate the gripping, compensation, and/or bail assemblies. A load measuring device 1015 may be integral with or coupled to the drive shaft 1010 to measure the load (torque, weigh, tension, compression, etc.) on the drive shaft 1010 during operation of the tubular handling system 1000. In one embodiment, the load measuring device 1015 may include a torque sub, a strain gauge, and/or a load cell. The gripping assembly 1020 may include one or more piston/cylinder assemblies 1025 operable to actuate a gripping tool of the tubular handing system 1000 for engagement with a tubular or tubular string. The compensation assembly 1030 may include one or more piston/cylinder assemblies 1035 operable to facilitate movement of the gripping tool relative to the tubular handling system 1000 to compensate for any loads formed in the tubular handling system 1000 and/or the tubular connections during tubular handling operations. A drive mechanism, such as a top drive, may be used to rotate the drive shaft 1010 and thereby rotate a tubular or tubular string that is gripped by the tubular handling system 1000 for making up and/or breaking out a tubular connection. The tubular handling system 1000 may be used with the embodiments described above regarding the tubular handling tools 20, 30, 80, 90, 120, 130 and the electronic control systems 10, 100.

Figure 8D:
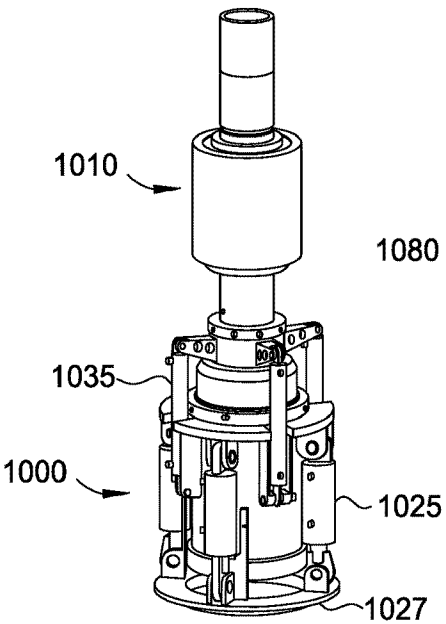

The tubular handling system 1000 may be adapted for interchangeable and/or modular use, as shown in FIGS. 8D-8H. One tubular handling system 1000 may be adapted to operate any size or variety of modular gripping tools 1080. FIG. 8D illustrates the tubular handling system 1000 having piston/cylinder assemblies 1025, 1035 for the gripping and compensation assemblies 1020, 1030, respectively, and the drive shaft 1010 for coupling the tubular handling system 1000 to a drive mechanism, such as a top drive system. FIGS. 8E-8H illustrate various exemplary modular gripping tools 1080 that may be used with the tubular handling system 1000. Actuation of the selected gripping tool 1080 is effected using a modular slip ring 1027 of the gripping assembly 1020. The modular slip ring 1027 couples to the piston/cylinder assemblies 1025 and is movable therewith. The modular slip ring 1027 is adapted to couple to a mating slip ring 1029 of the modular gripping tools 1080. When coupled to the mating slip ring 1029, the modular slip ring 1027 may actuate the gripping tool 1080. In this respect, the slip rings 1027, 1029 move in unison in response to actuation of the piston/cylinder assemblies 1025 of the gripping assembly 1020, which, in turn, causes engagement or disengagement the gripping tool 1080 from a tubular or tubular string. Torque from the drive mechanism may be transferred to the modular gripping tool 1080 using a universal couple 1026. As illustrated, the universal couple 1026 is positioned at the end of a rotational shaft 1028 for each modular gripping tool 1080. The universal couple 1026 is adapted to couple to a shaft, such as the drive shaft 1010, within the tubular handling system 1000. With the universal couple 1026 coupled to the shaft of the tubular handling system 1000, rotation may be transferred from the drive mechanism to the rotational shaft 1028 and in turn to the tubular or tubular string via the modular gripping tool 1080.

In operation, the modular aspect of the tubular handling system 1000 allows for quick and easy accommodation of any size tubular without the need for removing the tubular handling system 1000 and/or the drive mechanism. Thus, the external modular gripping tool 1080, shown in FIG. 8E, may be used initially to grip, couple, and drill with the tubular. The external modular gripping tool 1080 may then be removed by uncoupling the slip ring 1029 from slip ring 1027. The internal gripping tools 1080, shown in FIGS. 8F-8H, may then be used to continue to couple, run, and drill with tubulars. It is contemplated that gripping apparatus of any suitable size may be used during operations. Any of the tubular handling systems described herein may be used in conjunction with the modular gripping tools 1080 and/or with other non-modular gripping systems.

Figure 9A:
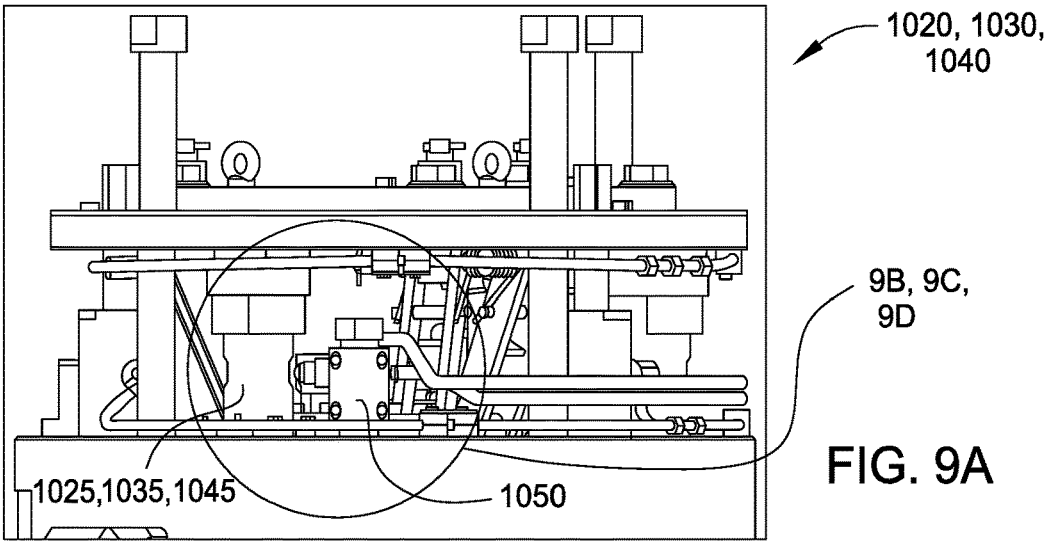
FIGS. 9A-9D illustrate a sensor for use with the tubular handling system according to one embodiment.
Figure 9B:
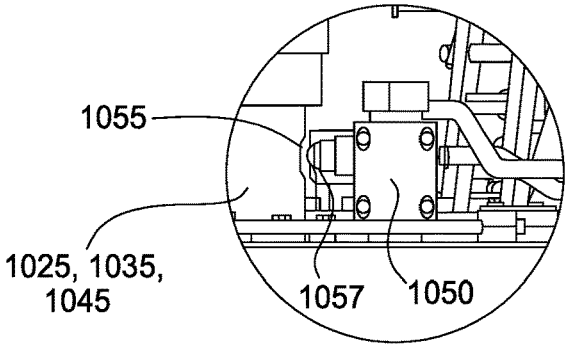
Figure 9C:
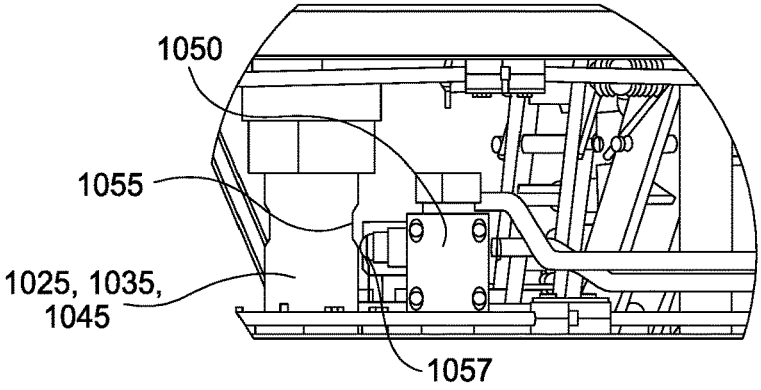
Figure 9D:
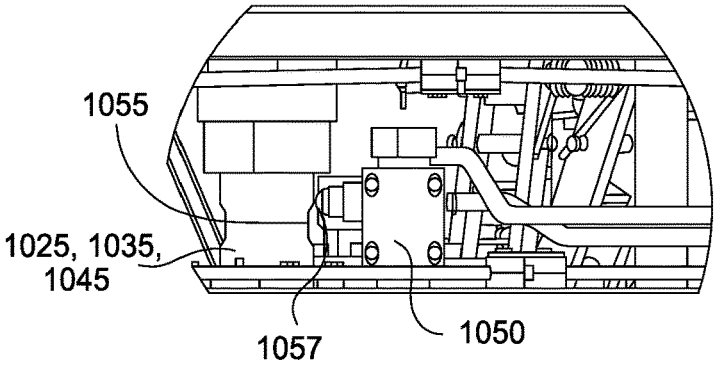

FIGS. 9A-9D illustrate one example of a sensor 1050, such as a position switch, that can be used with the embodiments described herein. Other types of sensors known in the art may also be used. In one embodiment, the sensor 1050 is attached to the tubular handling system 1000 and may be configured to generate a signal corresponding to a position of at least one of the piston/cylinder assemblies 1025, 1035, 1045. In particular, an indicator 1057 of the sensor 1050 engages the outer surface of a shaft of the piston/cylinder assemblies 1025, 1035, 1045 as they are extended and retracted. The shaft may include a groove or recess 1055 in its outer surface into which the indicator 1057 may move to generate a signal corresponding to a particular position of the piston/cylinder assemblies 1025, 1035, 1045. In one embodiment, as illustrated in FIG. 9B, when the indicator 1057 is in a middle position of the recess 1055, the sensor 1050 may send a signal to the electronic control system that indicates the gripping assembly 1020, the compensation assembly 1030, and/or the bail assembly 1040 is properly set or positioned, or is in a fully or partially extended/retracted position. In one embodiment, the measured position may indicate that the bails 1047 of the bail assembly 1040 are located at a first position adjacent to the tubular handling system 1000 and/or are located at a second position radially outward from the tubular handling system 1000. In one embodiment, the measured position may indicate that the compensation assembly 1040 is in a first extended position and/or a second retracted position. In one embodiment, the measured position may indicate that one or more slips of the gripping tool of the tubular handling system 1000 are properly engaging a tubular. In another embodiment, as illustrated in FIGS. 9C and 9D, when the indicator 1057 is not in the recess 1055, such as above or below the recess 1055, the sensor 1050 may send a signal to the electronic control system that indicates the gripping assembly 1020, the compensation assembly 1030, and/or the bail assembly 1040 is not properly set or positioned, or is not in a fully or partially extended/retracted position. For example, the recess 1055 may not reach the sensor 1050 if the tubular coupling with its larger diameter is being clamped or if the tubular or gripping tool diameters are mismatched. In another example, the recess 1055 may move too far past the sensor 1050 if there is no tubular in the gripping tool or again if the tubular or gripping tool diameters are mismatched. The measured position may thus indicate that the gripping tool of the tubular handling system 1000 is engaging the tubular at an incorrect location and/or is not engaging or adequately engaging the tubular. One or more sensors 1050 and/or one or more recesses 1055 may be configured with the piston/cylinder assemblies 1025, 1035, 1045 to obtain information about the operational status of the assemblies to conduct a tubular handling operation. If an operator initiates operation of the tubular handling system 1000 via the electronic control system, and the sensor 1050 is communicating a signal to the electronic control system that indicates one or more of the system 1000 components is not in the requisite operational state, then the electronic control system may prevent actuation of the system 1000 to prevent mishandling of a tubular or tubular string.

In one embodiment, one or more sensors, such as sensors 27, 28, 29, 98, 99A-B, 128, 150, etc., are attached to the piston/cylinder assemblies 1035 of the compensation assembly 1030 to measure the position and/or operating pressure of the assemblies. The sensors may be in communication with an electronic control system, such as electronic control systems 10, 100, via the electronic manifold 1124, such as electronic manifold 124 (each described above) that is coupled to the tubular handling system 1000. The sensors may send a signal corresponding to the position or amount of stroke of the piston/cylinder assemblies 1035. The load measuring device 1015 may also be in communication with the electronic control system via the electronic manifold 1124, and may send a signal corresponding to a load generated in the drive shaft 1010 during a tubular handling operation. Based on the position or amount of stroke of the piston/cylinder assemblies 1035 and/or the load in the drive shaft 1010, the electronic control system may actuate an electronically controlled valve (such as valves 45, 47, 49 described above with respect to FIGS. 1A and 1B) that controls fluid communication to actuate the piston/cylinder assemblies 1035 via hydraulic manifold 1060 for example. Actuation of the piston/cylinder assemblies 1035 may move the gripping tool relative to the tubular handling system 1000.

In one embodiment, the tubular handling system 1000 may be used to connect a tubular to a tubular string that is being supported by another tubular handling tool, such as a spider. The load measuring device 1015 may send a signal to the electronic control system to indicate that the tubular handling system 1000 is supporting the weight of the system 1000 only and is not supporting the weight of a tubular. Based on the load information, the electronic control system may allow actuation of the piston/cylinder assemblies 1035 to a fully extended position. The sensors on the piston/cylinder assemblies 1035 may send a signal to the electronic control system to indicate that the assemblies 1035 are in the fully extended position. The bail assembly 1040 may be used to grip a tubular, which may then be lifted to a position above the tubular string. The tubular may be set on the tubular string, and the tubular handling system 1000 may be lowered until the upper end of the tubular engages the gripping tool of the tubular handling system 1000.

The tubular handling system 1000 may be lowered further until the piston/cylinder assemblies 1035 are driven in to a retracted position, such as to a mid-stroke position of the piston/cylinder assemblies 1035. The sensors on the piston/cylinder assemblies 1035 may send a signal to the electronic control system to indicate that the assemblies 1035 are in the retracted position. Based on the piston/cylinder assembly 1035 position, the electronic control system may allow actuation of the gripping assembly 1040 and/or the top drive to grip and rotate the tubular to make the connection to the tubular string. The piston/cylinder assemblies 1035 may extend automatically to allow the gripping tool to move relative to the tubular handling system 1000 and/or the top drive to compensate for the thread makeup between the tubular and the tubular string. The sensors on the piston/cylinder assemblies 1035 may be used to monitor the position of the assemblies 1035 to ensure that they do not reach the fully extended position prior to completion of the tubular connection. The load measuring device 1015 may also be used to monitor the load in the tubular handling system 1000 during the tubular makeup operation to indicate any unexpected change in the load that may potentially harm the tubular connection and/or the tubular handling system 1000 and top drive.

In one embodiment, one or more sensors, such as sensors 27, 28, 29, 98, 99A-B, 128, 1050, etc. may be attached to piston/cylinder assemblies 1045 of the bail assembly 1040. The sensors may be in communication with the electronic control system, such as systems 10, 100, to communicate the (angular) position of bails 1047 relative to the tubular handling system 1000. In one embodiment, the fully retracted position of the piston/cylinder assemblies 1045 as measured by the sensors may indicate that the bails 1047 are substantially parallel to the longitudinal axis of the tubular handling system 1000. In one embodiment, the partially or fully extended position of the piston/cylinder assemblies 1045 as measured by the sensors may indicate that the bails 1047 are positioned at an angle relative to the longitudinal axis of the tubular handling system 1000. In one embodiment, one or more sensors may be used to measure an angular position of the bails 1047 relative to a specific reference axis, such as the horizontal axis, the vertical axis, and/or the longitudinal axis of the tubular handling system 1000 or one or more components of the tubular handling system 1000. One or more sensors, such as a laser/position sensor, may also be attached to the tubular handling system 1000 to measure the distance or height of the tubular handling system 1000 relative to another tubular handling system, such as a spider, and/or the rig floor. Based on the position of the bails 1047 and the location of the tubular handling system 1000 as measured by the sensors, the electronic control system is configured to actuate an electronically controlled valve (such as valves 45, 47, 49 described above with respect to FIGS. 1A and 1B) that controls fluid communication to actuate the piston/cylinder assemblies 1045 of the bail assembly 1040 via hydraulic manifold 1060 for example. Actuation of the piston/cylinder assemblies 1045 will move the bails 1047 between a position adjacent to or below the tubular handling system 1000 to a position outward from the tubular handing system 1000. A gripping tool, such as an elevator, is connected to the bails 1047 for supporting and moving a tubular to a position for gripping by the gripping tool of the tubular handling system 1000. After the tubular is supported by the gripping tool of the tubular handling system 1000, the bails 1047 may be moved from beneath the tubular handing system 1000 to avoid obstruction as the tubular is lowered toward the rig floor during the tubular handling operation. In one embodiment, the sensors may communicate the position of the bails 1047 to the operator's remote control panel 170 and/or driller's remote control panel 180 (as illustrated in FIGS. 6 and 7) via the electronic manifold 1124 and electronic control system during the tubular handling operation. In one embodiment, the electronic control system may automatically actuate the piston/cylinder assemblies 1045 based the position of the bails 1047 as measured by the sensors during the tubular handling operation. In this manner, the electronic control system may be used to control operation of the bail assembly 1040 and ensure that the bails 1047 are automatically and/or properly positioned during tubular handling operations. In one embodiment, the electronic control system may be operable to control actuation of the gripping tool that is connected to the bails 1047 using the embodiments described herein.

Figure 10:
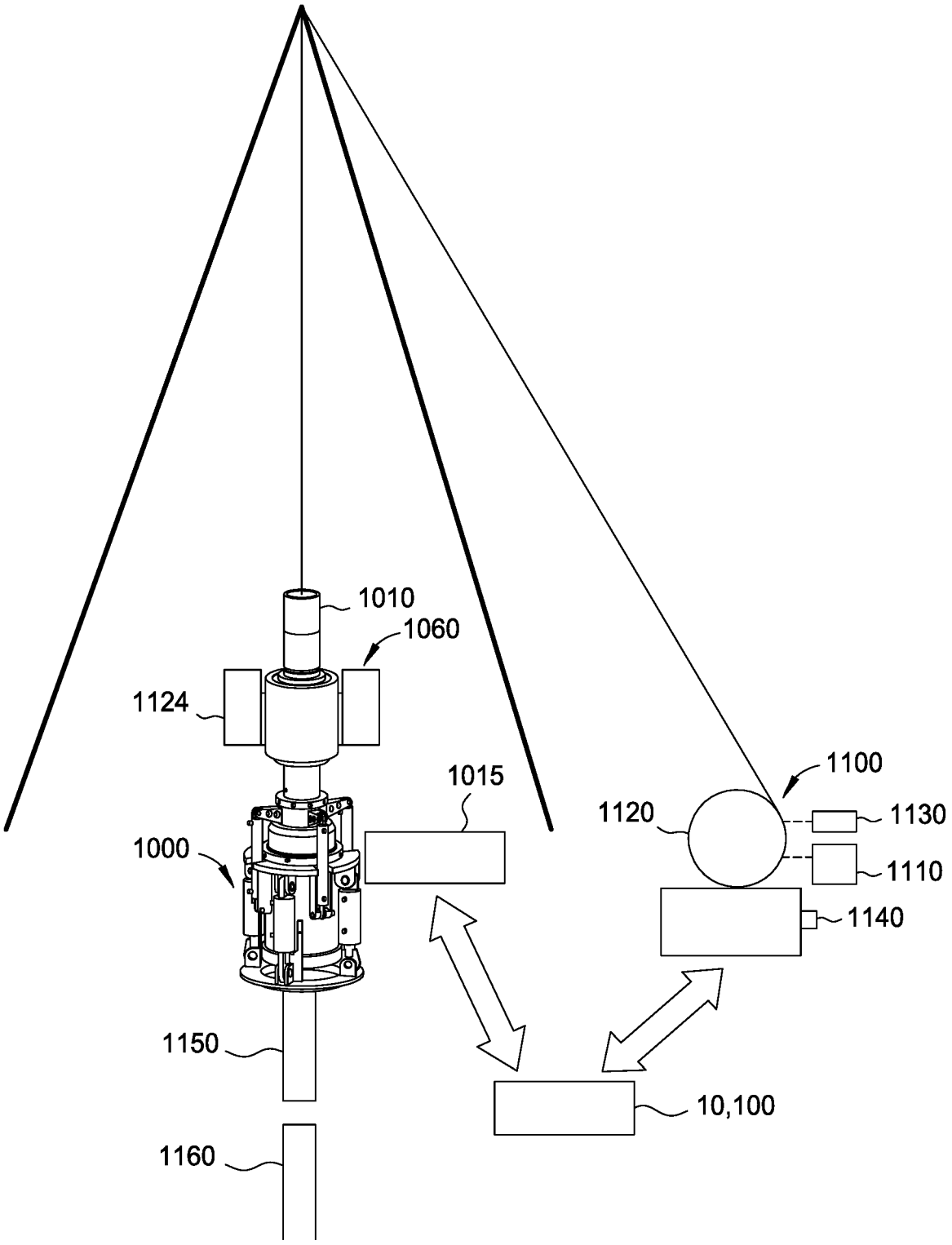
FIG. 10 illustrates the tubular handling system and a rig winch system according to one embodiment.

FIG. 10 illustrates the tubular handling system 1000 in communication with a rig winch system 1100. The tubular handling system 1000 and the electronic control system, such as systems 10, 100, may be used to communicate with the rig winch system 1100 that is used to raise and lower the tubular handling system 1000. In one embodiment, the load measuring device 1015 may send a signal to the electronic control system corresponding to the load generated in the drive shaft 1010 during a tubular handling operation. Based on the load information, the electronic control system may be configured to provide an indication to the rig winch operator to raise or lower the tubular handling system 1000. In one embodiment, the electronic control system may automatically actuate the rig winch system 1100 to lower or raise the tubular handling system 1000 based on the load information. The rig winch system 1100 may include a motor assembly 1110 for controlling rotation of a drum 1120 when used to raise the tubular handling system 1000, and a brake assembly 1130 for controlling rotation of the drum 1120 when used to lower the tubular handling system 1000. The electronic control system may actuate the motor assembly 1110 of the rig winch system 1100 to raise or lower the tubular handling system 1000. In addition, the electronic control system may actuate the brake assembly 1130 of the rig winch system 1100 to lower the tubular handling system 1000. One or more sensors 1140 may be attached to the motor assembly, the drum, and the brake assembly to communicate the operational status of the rig winch system 1100 to the electronic control system. Operation of the rig winch system 1100 may move the tubular handling system 1000 and/or the tubular 1150 supported by the tubular handling system 1000 relative to the tubular string 1160 supported by the other tubular handling system, such as a spider, to compensate for any load changes formed in the tubular handling systems and/or the tubulars 1150, 1160. When an operator initiates actuation of the rig winch system 1100 directly and/or through the electronic control system, the electronic control system may override, prevent, or allow the operator's command if certain pre-programmed conditions are not met and/or if the electronic control system is receiving signals from sensors that are not in accordance with certain pre-determined conditions with respect to the tubular handling tool 1000.

Figure 11A:
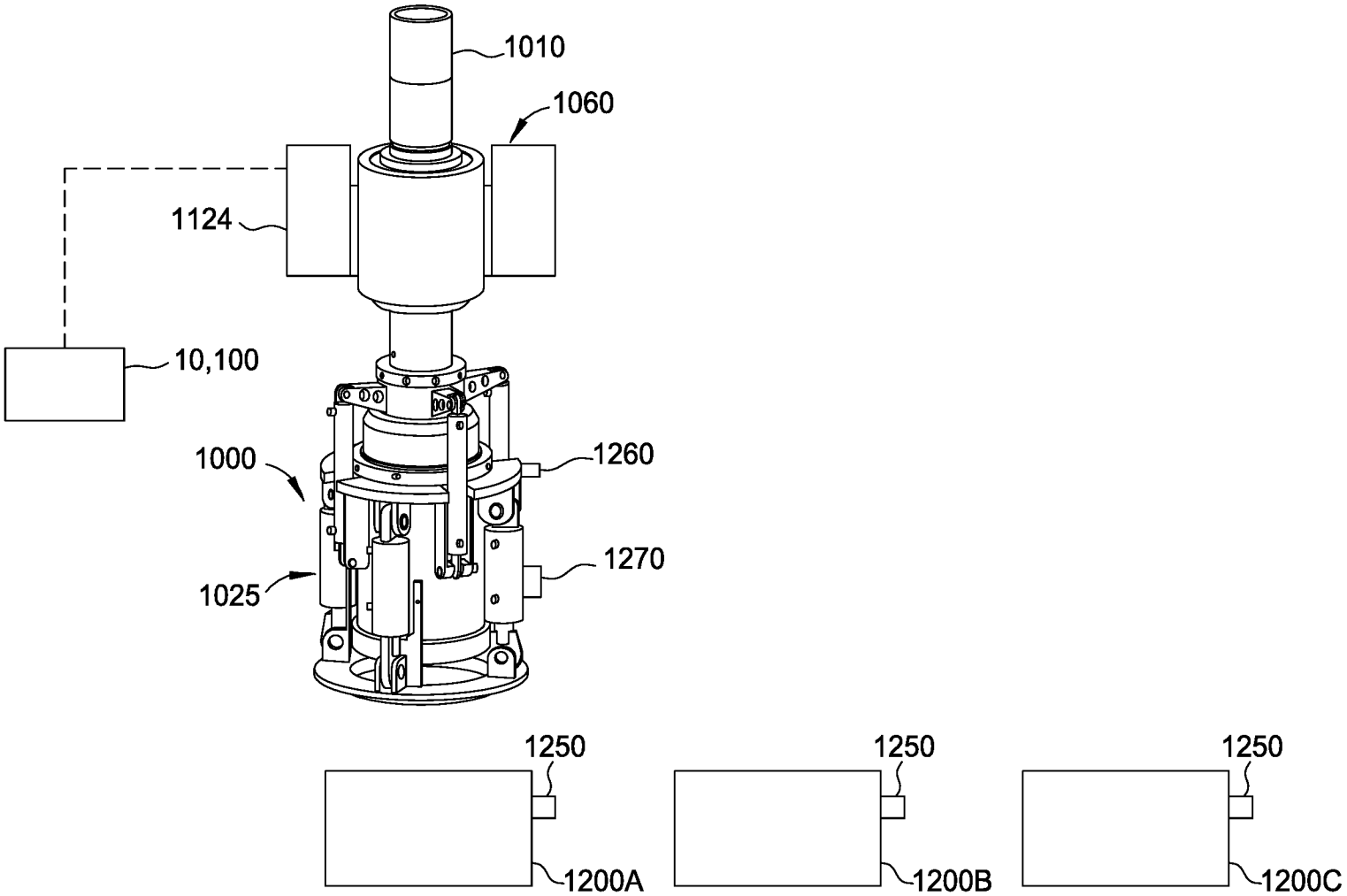
FIGS. 11A-11C illustrate the tubular handling system and gripping tools for use with the system according to one embodiment.

FIG. 11A illustrates the tubular handling system 1000 in communication with one or more gripping tools 1200A, 1200B, and 1200C, such as the gripping tools 1080 illustrated in FIGS. 8E-8H. The tubular handling system 1000 may be fitted with various gripping tools 1200A-C that are actuated by the piston/cylinder assemblies 1025 to handle different types and sizes of tubulars for different tubular handling operations. The gripping tools 1200A-C may be manually secured to and removed from the tubular handling system 1000. Each gripping tool 1200A-C may include one or more identification devices 1250, such as a radio frequency identification tag, that are encoded with information and store data relevant to the gripping tool, including but not limited to the type of gripping tool, the types and sizes of tubulars that the gripping tool may support, the number of jobs performed by the gripping tool, the maintenance history of the gripping tool, etc. One or more corresponding sensors 1260, such as a radio frequency identification tag reader, may also be attached to the tubular handling system 1000 and may communicate with the identification devices 1250 on the gripping tools 1200 to retrieve the data stored in the identification devices 1250 when the gripping tool 1200 is attached to or placed within a certain distance of the sensors 1260 on the tubular handling system 1000.

The sensors 1260 are also in communication with the electronic control system, such as systems 10, 100, via the electronic manifold 1124. One or more sensors 1270, such as sensors 27, 28, 29, 98, 99A-B, 128, 1050, etc. are attached to the piston/cylinder assemblies 1025 of the tubular handling system 1000. The sensors 1260, 1270 communicate with the electronic control system 10, 100 via the electronic manifold 1124 to send information regarding the specific gripping tool 1200A-C being used and the position or amount of stroke the piston/cylinder assemblies 1025 should be operated to properly engage and disengage a specific tubular size. Based on the information from the sensors 1260, 1270, the electronic control system 10, 100 is configured to actuate an electronically controlled valve (such as valves 45, 47, 49 described above with respect to FIGS. 1A and 1B) that controls fluid communication to actuate the piston/cylinder assemblies 1025. Actuation of the piston/cylinder assemblies 1025 will actuate the gripping tool 1200A-C that is connected thereto to grip or release tubulars during tubular handling operations. In one embodiment, the sensors 1260, 1270 may communicate the gripping stroke range of the particular type of gripping tool 1200A-C attached to the piston/cylinder assemblies 1025, as well as the position of the piston/cylinder assemblies 1025, to the electronic control system 10, 100, the operator's remote control panel 170, and/or driller's remote control panel 180 (as illustrated in FIGS. 6 and 7). The measured data may be compared by the electronic control system 10, 100, the operator, and/or the driller to thereby actuate the piston/cylinder assemblies 1025 and thus the gripping tool 1200A-C into proper engagement or disengagement with tubulars as necessary. In one embodiment, the electronic control system 10, 100 may automatically actuate the piston/cylinder assemblies 1025 based on their measured position and the type of gripping tool 1200A-C that is connected thereto during tubular handling operations. The information regarding the specific gripping tool 1200A-C that is connected to the tubular handling system 1000 may be analyzed by the electronic control system 10, 100 to ensure that the piston/cylinder assemblies 1025 are actuated within the operational range of the gripping tool 1200A-C to thereby ensure that each tubular is properly gripped and released during tubular handling operations. In one embodiment, when an operator initiates actuation of the tubular handling system 1000 directly or via the electronic control system, the electronic control system may override, prevent, or allow the operator's command if certain pre-programmed conditions are not met and/or if the electronic control system is receiving signals from sensors that are not in accordance with certain pre-determined conditions with respect to the tubular handling tool 1000 or gripping tools 1200A-C attached thereto.

Figure 11C:
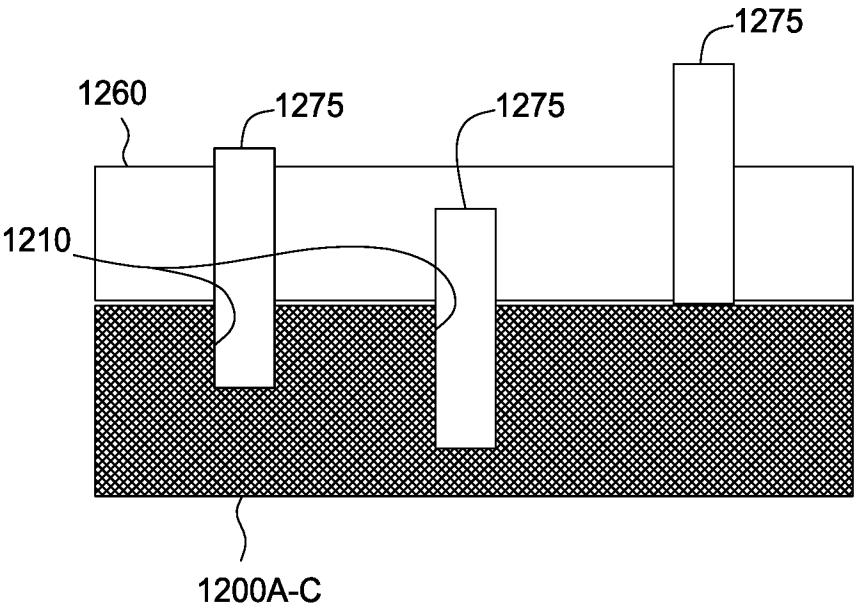
Figure 11B:
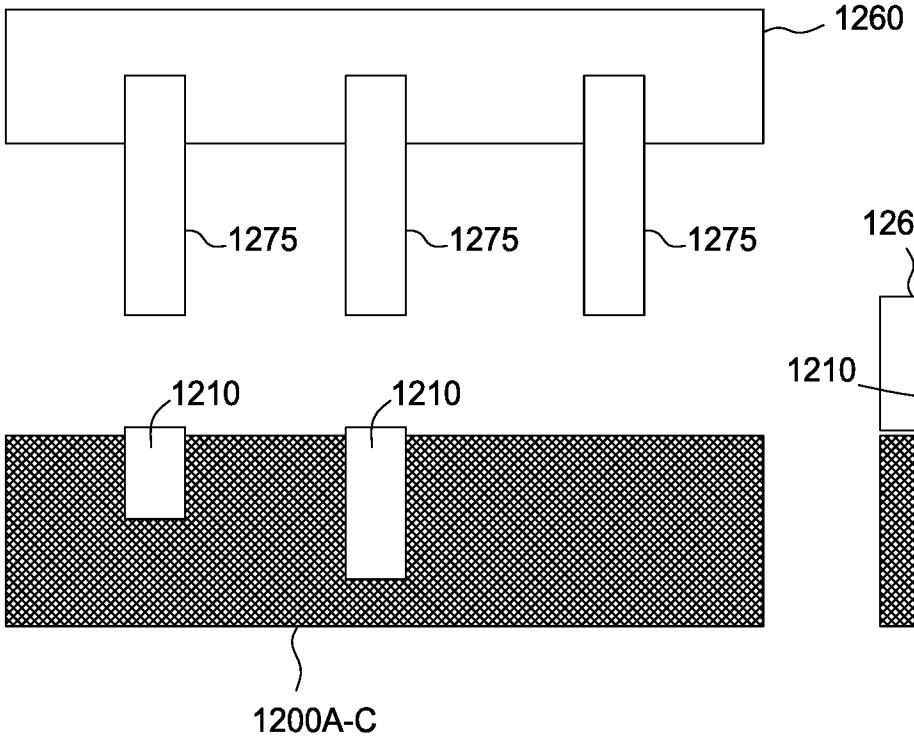

FIGS. 11B and 11C illustrate another embodiment used to identify the type of gripping tool that is connected to the tubular handling system 1000. The sensor 1260 may be coupled to the tubular handling system 1000, and may include one or more sensing members 1275, which may be sprung/movable pins, solenoid-type devices, or other types of electrical contacts. Each gripping tool 1200A-C may have one or more corresponding identification devices or means, such as holes or recesses 1210, which are arranged to communicate with or receive/engage one or more of the sensing members 1275. When the gripping tool 1200A-C is connected with the tubular handling system 1000, the sensing members 1275 are moved from a first (neutral) position, as illustrated in FIG. 11B, to a second (identifying) position, as illustrated in FIG. 11C. The travel distance or movement of the individual sensing member 1275 may collectively generate a signal that is sent to the electronic control system corresponding to the specific type of gripping tool 1200A-C that is attached to the tubular handling system 1000. The sensor 1260 may be operable to communicate the relevant data regarding the specific gripping tool 1200A-C to the electronic control system as well. In one embodiment, the electronic control system may retrieve the relevant data regarding the gripping tool 1200A-C from another source for use during operation.

Figure 12:
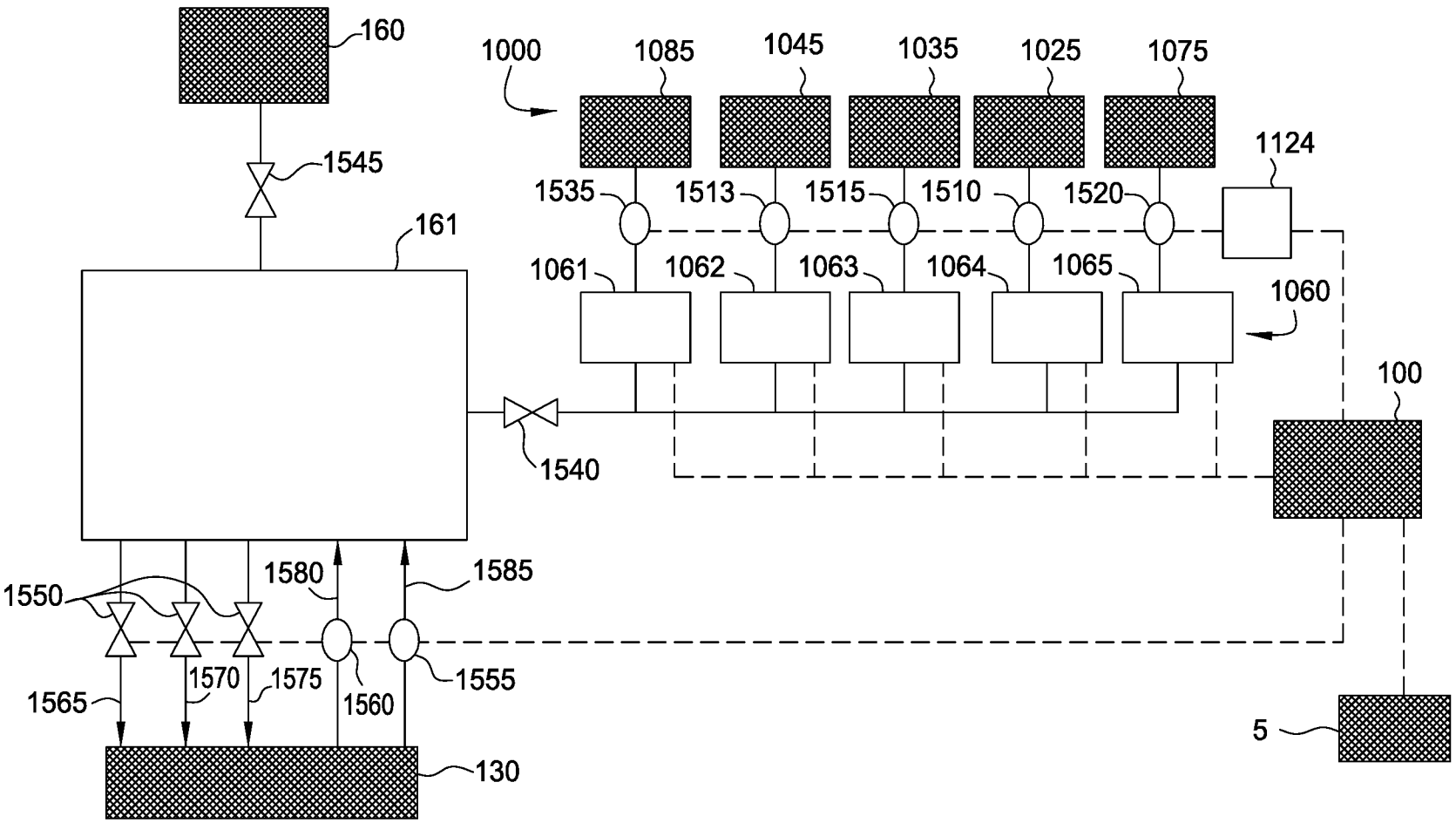
FIG. 12 illustrates a hydraulic/electrical schematic of the tubular handling system according to one embodiment.

FIG. 12 illustrates one embodiment of a hydraulic/electrical schematic for use with the tubular handling system 1000, as well as the other tools/systems described herein. The hydraulic manifold 1060 may include electronically controlled valve assemblies 1061, 1062, 1063, 1064, 1065 (such as solenoid valve assemblies) for controlling the supply and/or return of fluid to the tubular handling system 1000 components. The valve assembly 1061 may supply/return fluid to a gripping tool 1085, such as a single joint elevator, that is coupled to bails 1047 of the bail assembly 1040. A sensor 1535, such as a pressure sensor or switch, may be operable to measure fluid pressure within fluid lines to the gripping tool 1085 and communicate the pressure measurement to the electronic control system 100 via the electronic manifold 1124. The electronic control system 100 may open and close the valve assembly 1061 to thereby actuate the gripping tool 1085. The valve assembly 1062 may supply/return fluid to the piston/cylinder assemblies 1045 of the bail assembly 1040. A sensor 1513, such as a pressure sensor or switch, may be operable to measure fluid pressure within fluid lines to the piston/cylinder assemblies 1045 and communicate the pressure measurement to the electronic control system 100 via the electronic manifold 1124. The electronic control system 100 may open and close the valve assembly 1062 to thereby actuate the bail assembly 1040. The valve assembly 1063 may supply/return fluid to the piston/cylinder assemblies 1035 of the compensation assembly 1030. A sensor 1515, such as a pressure sensor or switch, may be operable to measure fluid pressure within fluid lines to the piston/cylinder assemblies 1035 and communicate the pressure measurement to the electronic control system 100 via the electronic manifold 1124. The electronic control system 100 may open and close the valve assembly 1063 to actuate the compensation assembly 1030. The valve assembly 1064 may supply/return fluid to the piston/cylinder assemblies 1025 of the gripping assembly 1020. A sensor 1510, such as pressure sensor or switch, may be operable to measure fluid pressure within fluid lines to the piston/cylinder assemblies 1025 and communicate the pressure measurements to the electronic control system 100 via the electronic manifold 1124. The electronic control system 100 may open and close the valve assembly 1064 to thereby actuate the gripping assembly 1020. The valve assembly 1065 may supply/return fluid to a fill-up tool 1075 of the tubular handling system 1000. A sensor 1520, such as a pressure sensor or switch, may be operable to measure fluid pressure within fluid lines to the fill-up tool 1075 and communicate the pressure measurement to the electronic control system 100 via the electronic manifold 1124. The electronic control system 100 may open and close the valve assembly 1065 to thereby actuate the fill-up tool 1075. The pressure measurements communicated to the electronic control system 100 may correspond to one or more operational characteristics of the tubular handling system 1000 components.

Fluid may be supplied to the valve assemblies of the hydraulic manifold 1060 by fluid (hydraulic and/or pneumatic) source 160 via a fluid manifold 161, which also supplies fluid to tubular handling system 130. Control lines 1565, 1570, 1575, 1580, 1585 may be provided to direct fluid to the tubular handling system 130 during use with the tubular handling system 1000. In particular, control lines 1565, 1570, 1575 may be used to supply pneumatic and/or hydraulic fluid to actuate the tubular handling system 130 into an open and closed position. Control lines 1580, 1585 may be used to communicate a pneumatic and/or hydraulic pressure signal corresponding to the position of the tubular handling system 130 to indicate whether the system 130 is clamping or engaging a tubular. One or more sensors 1555, 1560, such as pressure sensors or switches, may be operable to measure the pneumatic and/or hydraulic pressure signals and communicate the pressure measurements to the electronic control system 100. The electronic control system 100 may open and close one or more electronically controlled valves 1550 to thereby actuate the tubular handling system 130. Valve 1540 may be provided to manually override the interlock function of the electronic control system 100 by closing fluid communication to the hydraulic manifold 1060 and opening fluid communication directly to one or more of the tubular handling system 1000 components. Valve 1545 may be provided to control (open and close) fluid supply from the fluid source 160 to both tubular handling systems 130, 1000.

An operator 5 may use the electronic control system 100 to operate the tubular handling systems 130, 1000. During operation, the electronic control system 100 receives electronic signals corresponding to pressure measurements from the various sensors, which indicate one or more operational characteristics of the tubular handling system 130, 1000 components. Based on the operational characteristic of either tubular handling system 130, 1000, the electronic control system 100 is programmed to function as an electronic interlock by automatically preventing or allowing actuation of the tubular handling systems 130, 1000 to prevent inadvertent handling of a tubular or tubular string.

While the foregoing is directed to embodiments of the invention, other and further embodiments of the invention may be devised without departing from the basic scope thereof, and the scope thereof is determined by the claims that follow.

The invention claimed is:

1. A tubular handling system, comprising:

an electronic control system;

a gripping tool having an identification device;

an actuation assembly configured to actuate the gripping tool, wherein the gripping tool is selectively connectable to the actuation assembly; and a first sensor connected to the actuation assembly, wherein the first sensor is configured to transmit a signal to the electronic control system corresponding to information regarding the gripping tool that is retrieved or received from the identification device, wherein the electronic control system is configured to actuate the actuation assembly to actuate the gripping tool based on the information.

2. The system of claim 1, further comprising a second sensor configured to transmit a signal to the electronic control system corresponding to an operational position of the actuation assembly.

3. The system of claim 2, wherein the electronic control system is configured to actuate a valve that controls fluid communication to a piston/cylinder assembly of the actuation assembly to actuate the actuation assembly based on the information and the operational position.

4. The system of claim 2, wherein the operational position is based on a measurement of an amount of stroke of a piston/cylinder assembly that actuates the actuation assembly.

5. The system of claim 1, wherein the first sensor includes a radio frequency identification tag reader, and wherein the identification device includes a radio frequency identification tag.

6. The system of claim 1, wherein the first sensor includes one or more sensing members, and wherein the identification device includes one or more recesses configured to receive the one or more sensing members when the gripping tool is coupled to the actuation assembly.

7. The system of claim 1, wherein the information includes at least one of a type of the gripping tool, a type of tubular that the gripping tool supports, a size of tubular that the gripping tool supports, or a job/maintenance history of the gripping tool.

8. The system of claim 7, wherein the information includes the type of the gripping tool and the type of tubular that the gripping tool supports.

9. The system of claim 1, wherein the electronic control system is configured to actuate a valve that controls fluid communication to a piston/cylinder assembly of the actuation assembly to actuate the actuation assembly and thereby actuate the gripping tool.

10. The system claim 1, wherein the electronic control system is configured to override, prevent, or allow an operator's command if certain pre-programmed conditions are not met and/or if the electronic control system is receiving a signal from the first sensor that is not in accordance with certain pre-determined conditions.

11. The system of claim 1, wherein the gripping tool is configured to be suspended above a rig floor.

12. The system of claim 1, wherein the first sensor retrieves or receives the information from the identification device when the gripping tool is connected to the actuation assembly.

13. A method of actuating a tubular handling system, comprising:

receiving a first electronic signal from a first sensor corresponding to information regarding a gripping tool that is received or retrieved from an identification device of the gripping tool, wherein the first sensor is connected to an actuation assembly configured to actuate the gripping tool;

receiving a second electronic signal from a second sensor corresponding to an operational position of the actuation assembly;

connecting the gripping tool to the actuation assembly; and actuating the actuation assembly to actuate the gripping tool based on the information and the operational position.

14. The method of claim 13, further comprising actuating a valve that controls fluid communication to a piston/cylinder assembly of the actuation assembly to actuate the actuation assembly based on the information and the operational position.

15. The method of claim 13, further comprising comparing the information and the operational position to actuate the actuation assembly and thereby actuate the gripping tool an amount necessary to grip or release a tubular.

16. The method of claim 13, further comprising analyzing the information and the operational position to actuate the actuation assembly and thereby actuate the gripping tool within an operational range of the gripping tool.

17. The method of claim 13, wherein the operational position is based on a measurement of an amount of stroke of a piston/cylinder assembly that actuates the actuation assembly.

18. The method of claim 13, wherein the first sensor includes a radio frequency identification tag reader, and wherein the identification device includes a radio frequency identification tag.

19. The method of claim 13, wherein the first sensor includes one or more sensing members, and wherein the identification device includes one or more recesses configured to receive the one or more sensing members when the gripping tool is coupled to the actuation assembly.

20. The method of claim 13, wherein the information includes at least one of a type of the gripping tool, a type of tubular that the gripping tool supports, a size of tubular that the gripping tool supports, or a job/maintenance history of the gripping tool.

21. The method of claim 20, wherein the information includes the type of the gripping tool and the type of tubular that the gripping tool supports.

22. The method of claim 13, further comprising actuating a valve to supply fluid to a piston/cylinder assembly to actuate the actuation assembly to actuate the gripping tool based on the information.

23. The method of claim 13, further comprising overriding, preventing, or allowing an operator's command if certain pre-programmed conditions are not met and/or if a electronic control system is receiving an electronic signal from the first sensor that is not in accordance with certain pre-determined conditions.

24. A system, comprising:

a gripping tool having an identification device; and a tubular handling system, wherein the gripping tool is selectively attachable to the tubular handling system, wherein the tubular handling system includes:

an electronic control system;

an actuation assembly configured to actuate the gripping tool; and a first sensor connected to the actuation assembly and configured to transmit a signal to the electronic control system corresponding to information regarding the gripping tool that is retrieved or received from the identification device, wherein the electronic control system is configured to actuate the actuation assembly to actuate the gripping tool based on the information.

25. The system of claim 24, further comprising a second sensor configured to transmit a signal to the electronic control system corresponding to an operational position of the actuation assembly.

26. The system of claim 24, wherein the information is at least one of a type of the gripping tool, a type of tubular that the gripping tool supports, a size of tubular that the gripping tool supports, or a job/maintenance history of the gripping tool.

27. The system of claim 26, wherein the information includes the type of the gripping tool and the type of tubular that the gripping tool supports.

28. A tubular handling system, comprising:

an electronic control system;

a gripping tool having an identification device;

an actuation assembly configured to actuate the gripping tool; and a first sensor configured to transmit a signal to the electronic control system corresponding to information regarding the gripping tool that is retrieved or received from the identification device, wherein the electronic control system is configured to actuate the actuation assembly to actuate the gripping tool based on the information;

wherein:

the first sensor includes one or more sensing members, and wherein the identification device includes one or more recesses configured to receive the one or more sensing members when the gripping tool is coupled to the actuation assembly.

* * * * *